US011834934B2

(12) United States Patent
Prisbell et al.

(10) Patent No.: US 11,834,934 B2
(45) Date of Patent: Dec. 5, 2023

(54) MODULAR PERFORATION TOOL

(71) Applicant: Schlumberger Technology Corporation, Sugar Land, TX (US)

(72) Inventors: Andrew Prisbell, Sugar Land, TX (US); Atsushi Nakano, Sugar Land, TX (US); Todd Busch, Alvin, TX (US); Erick Lowe, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 172 days.

(21) Appl. No.: 17/595,411

(22) PCT Filed: May 14, 2020

(86) PCT No.: PCT/US2020/032879

§ 371 (c)(1),
(2) Date: Nov. 16, 2021

(87) PCT Pub. No.: WO2020/232242

PCT Pub. Date: Nov. 19, 2020

(65) Prior Publication Data

US 2022/0213767 A1 Jul. 7, 2022

Related U.S. Application Data

(60) Provisional application No. 63/011,082, filed on Apr. 16, 2020, provisional application No. 62/848,856, filed on May 16, 2019.

(51) Int. Cl.
*E21B 43/117* (2006.01)
*E21B 43/118* (2006.01)
(Continued)

(52) U.S. Cl.
CPC ..... *E21B 43/117* (2013.01); *E21B 43/1185* (2013.01); *E21B 43/119* (2013.01)

(58) Field of Classification Search
CPC ..... E21B 43/116; E21B 43/117
See application file for complete search history.

(56) References Cited

U.S. PATENT DOCUMENTS 2,062,974 A 12/1936 Lane
2,252,270 A 8/1941 Miller
(Continued)

FOREIGN PATENT DOCUMENTS

CA 2532088 C 1/2005
CA 3044516 A1 7/2018
(Continued)

OTHER PUBLICATIONS

Titan H2 Perforating Gun System, (2019) 2 pages, Link: https://www.oilfieldtechnology.com/product-news/07022019/hunting-introduces-h-2-perforating-system/.
(Continued)

*Primary Examiner* — Cathleen R Hutchins
(74) *Attorney, Agent, or Firm* — Jeffrey D. Frantz

(57) ABSTRACT

A perforation tool for use in a well bore is described herein. The perforation tool comprises a housing; a plurality of frames that fit inside the housing, each frame having a cylindrical shape with a central axis and a plurality of liners, each liner having an axis perpendicular to the central axis, wherein the axes of the liners of each frame are disposed in a plane perpendicular to the central axis, and the frames are axially stackable; an electrical conductor disposed along a central passage of each frame; a plurality of shaped charges secured in the liners of the frames; a bulkhead member disposed in the housing and forming a seal with the housing; and an initiator module disposed in the housing with the bulkhead member between the initiator module and the plurality of frames.

18 Claims, 10 Drawing Sheets

(51) Int. Cl.
*E21B 43/119* (2006.01)
*E21B 43/1185* (2006.01)

(56) References Cited

U.S. PATENT DOCUMENTS 2,980,017 A 4/1961 Castel
3,173,992 A 3/1965 Boop
3,612,189 A 10/1971 Brooks et al.
3,836,843 A 9/1974 Yonce
4,004,643 A 1/1977 Newman
4,191,265 A 3/1980 Bosse-Platiere
4,296,481 A 10/1981 Weiss
4,519,313 A 5/1985 Leidel
4,523,649 A 6/1985 Stout
4,619,333 A 10/1986 George
4,759,291 A 7/1988 Barker et al.
4,850,438 A 7/1989 Regalbuto
4,909,320 A 3/1990 Hebert et al.
5,007,486 A 4/1991 Ricles
5,351,622 A * 10/1994 Ekholm ..... F42B 1/02 102/306
5,756,926 A 5/1998 Bonbrake et al.
6,082,265 A 7/2000 Sakamoto et al.
6,311,621 B1 11/2001 Marshall et al.
6,412,338 B2 7/2002 Boyle et al.
6,595,290 B2 7/2003 George
6,752,083 B1 6/2004 Lerche et al.
7,013,977 B2 3/2006 Nordaas
8,002,035 B2 8/2011 Hales et al.
8,066,083 B2 11/2011 Hales et al.
8,127,848 B2 3/2012 Myers, Jr. et al.
8,443,886 B2 5/2013 Torres et al.
9,115,572 B1 8/2015 Hardesty et al.
9,382,784 B1 7/2016 Hardesty et al.
9,494,021 B2 11/2016 Parks et al.
9,581,422 B2 2/2017 Preiss et al.
9,605,937 B2 3/2017 Fitschberger et al.
9,702,680 B2 7/2017 Parks et al.
9,903,185 B2 2/2018 Ursi et al.
10,188,990 B2 1/2019 Burmeister et al.
10,190,398 B2 1/2019 Goodman et al.
10,273,788 B2 4/2019 Bradley et al.
10,338,030 B2 7/2019 Bittar et al.
10,429,161 B2 10/2019 Parks et al.
10,458,213 B1 10/2019 Eitschberger et al.
10,472,938 B2 11/2019 Parks et al.
10,677,026 B2 6/2020 Sokolove et al.
10,746,003 B2 8/2020 Yang et al.
10,900,334 B2 1/2021 Knight et al.
11,078,762 B2 8/2021 Mauldin et al.
11,293,737 B2 4/2022 Sullivan et al.
2004/0216632 A1* 11/2004 Finsterwald ..... F42D 1/043 102/275.12
2004/0216866 A1 11/2004 Barlow et al.
2005/0211467 A1 9/2005 Ratanasirigulchia et al.
2008/0149338 A1* 6/2008 Goodman ..... E21B 43/117 166/299
2009/0151589 A1 6/2009 Henderson et al.
2009/0159285 A1 6/2009 Goodman
2010/0005992 A1 1/2010 Crawford
2010/0011945 A1 1/2010 Loehr
2010/0024674 A1 2/2010 Peeters et al.
2010/0300750 A1 12/2010 Tales et al.
2011/0024116 A1* 2/2011 McCann ..... E21B 43/1185 166/55
2012/0018157 A1 1/2012 Gill et al.
2012/0138286 A1 6/2012 Mason et al.
2012/0152542 A1 6/2012 Le
2012/0180678 A1 7/2012 Kneisl
2012/0199352 A1 8/2012 Lanclos et al.
2012/0247769 A1 10/2012 Schacherer et al.
2012/0247771 A1* 10/2012 Black ..... E21B 43/1185 166/55
2013/0043074 A1 2/2013 Tassaroli
2013/0048376 A1 2/2013 Rodgers et al.
2013/0153205 A1 6/2013 Borgfeld et al.
2014/0312752 A1* 10/2014 Durisotti ..... H05K 5/0217 29/428
2014/0338552 A1 11/2014 Mace et al.
2015/0330192 A1 11/2015 Rogman et al.
2016/0168961 A1 6/2016 Parks et al.
2016/0356132 A1 12/2016 Burmeister et al.
2017/0052011 A1 2/2017 Parks et al.
2017/0176152 A1 6/2017 Goodman
2017/0211363 A1 7/2017 Bradley et al.
2017/0275976 A1 9/2017 Collins et al.
2018/0299239 A1 10/2018 Eitschberger et al.
2018/0306010 A1 10/2018 Von Kaenel et al.
2019/0040722 A1 2/2019 Yang et al.
2019/0186241 A1 6/2019 Yang et al.
2019/0195054 A1 6/2019 Bradley et al.
2019/0257181 A1 8/2019 Langford et al.
2019/0292887 A1 9/2019 Austin et al.
2019/0353013 A1 11/2019 Sokolove et al.
2020/0018139 A1 1/2020 Eitschberger et al.
2020/0024934 A1 1/2020 Eitschberger et al.
2020/0024935 A1 1/2020 Eitschberger et al.
2020/0048996 A1 2/2020 Anthony et al.
2020/0072029 A1 3/2020 Anthony et al.
2020/0256167 A1 8/2020 Gupta et al.

FOREIGN PATENT DOCUMENTS

CN 2244095 Y 1/1997
CN 1101575965 A 11/2009
EP 132330 A2 1/1985
EP 0175439 A2 3/1986
EP 0601880 A2 6/1994
EP 0919694 A2 6/1999
EP 1930541 A2 6/2008
EP 2268893 B1 11/2018
RU 73390 U1 5/2008
RU 78521 U1 11/2008
RU 121054 U1 10/2012
RU 2561828 C2 9/2015
SU 258201 A1 12/1969
WO 2001096807 A2 12/2001
WO 2011080291 A2 7/2011
WO 2012135101 A2 10/2012
WO 2013180765 A1 12/2013
WO 2014089194 A1 6/2014
WO 2014179669 A1 11/2014
WO 2018026952 A1 2/2018
WO 2018125180 A1 7/2018
WO 2018213782 A1 11/2018

OTHER PUBLICATIONS

Extended Search issued in European Patent Application No. 20752538.7 dated Sep. 30, 2022, 8 pages.
International Search Report and Written Opinion issued in the PCT Application No. PCT/US/2021/059401 dated Feb. 24, 2022, 11 pages.
International Preliminary Report on Patentability issued in the PCT Application PCT/US2021/059401 dated May 25, 2023, 8 pages.
Hunting introduces H-2 Perforating System, downloaded from https://www.oilfieldtechnology.com/product-news/07022019/hunting-introduces-h-2-perforating-system/, Oilfield Technology, Feb. 7, 2019, 2 pages.
GEODynamics, Hellfire perforating system, 2019, 2 pages.
International Search Report and Written Opinion issued in the PCT Application No. PCT/US2021/059400 dated Feb. 24, 2022, 8 pages.
International Preliminary Report on Patentability issued in the PCT Application No. PCT/US2021/059400 dated May 25, 2023, 7 pages.
Advisory Action issued in U.S. Appl. No. 14/888,882 dated Sep. 21, 2021, 6 pages.
Communication article 94-3 issued in the related EP application 13860417.8, dated Jan. 19, 2018 (5 pages).
Communication article 94-3 issued in the related EP application 13860417.8, dated Mar. 8, 2017 (6 pages).

(56) References Cited

OTHER PUBLICATIONS

Communication article 94-3 issued in the related EP application 13860417.8, dated Mar. 9, 2016 (6 pages).
Decision of Grant issued in the related RU application 2015126872, dated Dec. 1, 2016 (12 pages).
English translation of Exam Report issued in the related AR Patent Application No. 20140101829, dated Aug. 30, 2021, 2 pages.
European Search Report issued in the related EP application 13860417.8, dated Feb. 22, 2016 (6 pages).
Exam Report issued in the related AR Patent Application No. 20140101829 dated Apr. 16, 2020, 5 pages.
Exam Report issued in the related CA Application 2892378 dated Nov. 15, 2019, 4 pages.
H-2 Perforating System, Titan division, 2019 (1 page).
International Preliminary Report on Patentability issued in the PCT Application PCT/US2020/017262 dated Aug. 19, 2021, 11 pages.
International Preliminary Report on Patentability issued in the PCT Application PCT/US2020/032879 dated Nov. 25, 2021, 8 pages.
International Preliminary Report on Patentability issued in the related PCT application PCT/US2013/073094, dated Jun. 9, 2015 (5 pages).
International Preliminary Report on Patentability issued in the related PCT application PCT/US2014/036541, dated Nov. 3, 2015 (09 pages).
International Search Report and Written Opinion issued in the PCT Application PCT/US2020/017262 dated Jun. 19, 2020, 13 pages.
International Search Report and Written Opinion issued in the PCT Application PCT/US2020/032879, dated Aug. 28, 2020 (10 pages).
International Search Report and Written Opinion issued in the related PCT application PCT/US2013/073094, dated Mar. 20, 2014 (9 pages).
International Search Report and Written Opinion issued in the related PCT application PCT/US2014/036541, dated Sep. 12, 2014 (13 pages).
Merriam-Webster Dictionary, multiple various definitions for the term "bulkhead", published in Jan. 2013. (Year: 2013).
Notice of Allowance issued in U.S. Appl. No. 16/021,061 dated Aug. 11, 2021, 8 pages.
Office action issued in the related CN application 201380062953.4, dated Feb. 27, 2018 (11 pages).
Office action issued in the related CN application 201380062953.4, dated Jun. 15, 2017 (20 pages).
Office action issued in the related CN application 201380062953.4, dated Sep. 1, 2016 (22 pages).
Office action issued in the related RU application 2015126872, dated Aug. 19, 2016 (8 pages).
Office Action issued in the related U.S. Appl. No. 14/888,882 dated Dec. 3, 2021, 16 pages.
Office Action issued in the related U.S. Appl. No. 14/888,882 dated Apr. 13, 2021, 16 pages.
Office Action issued in the related U.S. Appl. No. 14/888,882 dated Jan. 30, 2020, 26 pages.
Office Action issued in the related U.S. Appl. No. 14/888,882 dated May 25, 2018 (36 pages).
Office Action issued in the related U.S. Appl. No. 16/021,061 dated Sep. 9, 2020, 11 pages.
Office Action issued in U.S. Appl. No. 17/235,616 dated Mar. 16, 2022, 8 pages.
Office Action and Search Report issued in Russian Patent Appl. No. 2021136889 dated Sep. 4, 2023; 14 pages (with English translation).

* cited by examiner

MODULAR PERFORATION TOOL

CROSS-REFERENCE TO RELATED APPLICATIONS

This application claims benefit of U.S. Provisional Patent Application Ser. No. 62/848,856 filed May 16, 2019 and U.S. Provisional Patent Application Ser. No. 63/011,082 filed Apr. 16, 2020, which are incorporated herein by reference.

FIELD

Embodiments of the present invention generally relate to well perforation in oil and gas recovery. Specifically, embodiments of a modular perforation tool are described herein.

BACKGROUND

Oil wells are holes drilled into the earth, sometimes under water. The holes may descend essentially straight into the earth, or may advance at an angle, or even sideways. The well provides a conduit for oil and gas, or indeed any flowable resource, to flow out of a geologic formation into the hole and up to the surface. The hole is often lined with a support material to keep the flow path open as fluids flow into the conduit. The support material can be a pipe, a concrete lining, or other support. Oil and gas flow through tiny fissures, cracks, and capillaries in the geologic formation under the influence of a pressure drop between the formation and the hole. As the fluids move through the formation, solids can be entrained in the fluid movement that can be lodged into the cracks and fissures, slowing recovery of fluids from the formation. As fluids are produced from the formation, the pressure of the formation can decline, reducing the pressure drop causing the fluids to flow.

In some cases, flow from the geologic formation can be enhanced by forming conduits from the well wall into the formation. These are openings that extend from the well wall into the formation providing an open pathway substantially immune to plugging with solids to promote free flow of oil and gas into the well from the formation. These conduits are typically formed by inserting a perforation tool into the well to fire explosive charges shaped to propel blast force in a desired pattern toward the well wall, often through a well casing and/or lining. The focused blast force pulverizes and removes a portion of the geology, rock or other geology, at the well wall and a radial distance from the well wall into the formation, sometimes up to 60 inches, to form a conduit. In most cases, more than one such conduit is formed in the well wall at different azimuths and depths depending on the production needs of the well.

A perforation tool, sometimes called a perforating gun, is a complex tool that delivers a firing impulse to one or more explosive charges positioned by the perforating gun to direct the blast from the shaped charge in a desired direction. The explosive charges are contained and held in position by a cage, and a firing circuit is electrically connected to the shaped charges. Transportation of such assemblies is heavily regulated worldwide, due to the propensity to set off an explosion. In most cases, the firing impulse sub-assembly must be transported separately from the explosive sub-assembly, and the tool assembled in the field. Such restrictions complicate delivering perforation tools to drill sites. Additionally, securing the shaped charges in a desired position in the perforating gun is challenging. Often, the shaped charges must be installed at specific positions in the perforating gun, restricting flexibility in applying the blast. A perforating gun is needed in the industry that is transportable and has more flexibility of operation.

SUMMARY

Embodiments described herein provide an apparatus, comprising a housing; a plurality of frames that fit inside the housing, each frame having a cylindrical shape with a central axis and a plurality of liners, each liner having an axis perpendicular to the central axis, wherein the axes of the liners of each frame are disposed in a plane perpendicular to the central axis, and the frames are axially stackable; an electrical conductor disposed along a central passage of each frame; a plurality of shaped charges secured in the liners of the frames; a bulkhead member disposed in the housing and forming a seal with the housing; and an initiator module disposed in the housing with the bulkhead member between the initiator module and the plurality of frames Other embodiments described herein provide a perforation tool, comprising a cylindrical housing having a plurality of perforation grooves formed therein; a plurality of charge frames that fit inside the housing, each charge frame having a cylindrical shape with a central axis and a plurality of liners positioned adjacent to one of the perforation grooves, each liner having an axis perpendicular to the central axis, wherein the axes of the liners of each charge frame are disposed in a plane perpendicular to the central axis, each liner has a retention member that extends around a circumference of the liner, and the charge frames are axially stackable; a plurality of shaped charges secured in the liners of the charge frames; a bulkhead member disposed in the housing and forming a seal with the housing; and an initiator module disposed in the housing with the bulkhead member between the initiator module and the plurality of charge frames.

Other embodiments described herein provide a perforation tool, comprising a cylindrical housing; a first perforation assembly disposed inside the housing, that first perforation assembly comprising a first frame for shaped charges, an initiator module, and a bulkhead member between the frame and the initiator module; and a second perforation assembly disposed inside the housing, the second perforation assembly comprising a second frame for shaped charges electrically coupled to the initiator module of the first perforation assembly by an electrical conductor disposed through a central passage of the second frame.

Other embodiments described herein provide a frame for housing shaped charges, comprising a body having a central axis, with a passage through the body along the central axis and a plurality of openings oriented transverse to the central axis, each opening comprising a wall having circular cross-section and diameter that declines from a first end of the opening to a second end of the opening, the first end of the opening having a circular rim and the second end of the opening having a port that fluidly couples the opening with the passage, each opening having a notch in the wall, the notch having a first side wall and a second side wall opposite the first side wall, with a restraint extending from the first side wall across the notch toward the second side wall.

Other embodiments described herein provide a frame for housing shaped charges, comprising a body having a central axis, with a passage through the body along the central axis and a plurality of openings oriented transverse to the central axis, each opening comprising a wall having circular cross-section and diameter that declines from a first end of the opening to a second end of the opening, the first end of the opening having a circular rim and the second end of the opening having a port that fluidly couples the opening with the passage, each opening having two rectangular notches in the wall on opposite sides, the two notches aligned along the central axis, with a restraint extending across each notch along the circumference of the opening.

Other embodiments described herein provide a frame for housing shaped charges, comprising a body having a central axis, with a passage through the body along the central axis and a plurality of openings oriented transverse to the central axis, each opening comprising a wall having circular cross-section and diameter that declines from a first end of the opening to a second end of the opening, the first end of the opening having a circular rim and the second end of the opening having a port that fluidly couples the opening with the passage, each opening having two rectangular notches in the wall on opposite sides, the two notches aligned along the central axis, with a restraint extending across each notch along the circumference of the opening, the body having a first end with a plurality of first alignment features and a second end opposite the first end with a plurality of second alignment features that match the first alignment features.

Other embodiments described herein provide an initiator module, comprising a first member having a contact ring with a tapered surface and a central opening; and a second member comprising a circuit plate coupled to the second member in a transverse orientation by a plurality of clips; and a central plug holding a detonator that protrudes through the central opening of the first member.

Other embodiments described herein provide an initiator module, comprising a first member having a contact ring at a first end of the initiator module, the contact ring having a tapered surface and a central opening; and a second member comprising a circuit plate coupled to the second member by a plurality of clips; and a central plug holding a detonator that protrudes through the central opening of the first member, wherein the initiator module has a cylindrical shape with a central axis, the circuit plate is oriented along a plane perpendicular to the central axis, the initiator module has a second end opposite from the first end, and the initiator module further comprises an electrical connector that protrudes from the second end.

Other embodiments described herein provide an initiator module, comprising a first member having a contact ring at a first end of the initiator module, the contact ring having a tapered surface and a central socket defining a central opening; and a second member comprising a circuit plate coupled to the second member by a plurality of clips; and a central plug holding a detonator that fits within the central socket of the first member, wherein the initiator module has a cylindrical shape with a central axis, the circuit plate is oriented along a plane perpendicular to the central axis, the initiator module has a second end opposite from the first end, and the initiator module further comprises a cylindrical electrical connector that protrudes from the second end.

Other embodiments described herein provide a bulkhead member for a perforation tool, the bulkhead member comprising a cylindrical body made from a structurally strong material the cylindrical body having a first end, a second end opposite the first end, and a central passage formed along an axis thereof from the first end to the second end; and an electrical conductor disposed in the passage along the axis and having a first end with a rounded prong that extends into a socket formed in the first end of the cylindrical body, and a second end that has an electrical coupling disposed at the second end of the cylindrical body.

Other embodiments described herein provide a bulkhead member for a perforation tool, the bulkhead member comprising a cylindrical body made from a structurally strong material the cylindrical body having a first end, a second end opposite the first end, and a central passage formed along an axis thereof from the first end to the second end; and an electrical conductor disposed in the passage along the axis and having a first end with a rounded prong that extends into a socket formed in the first end of the cylindrical body, and a second end that has an electrical coupling disposed at the second end of the cylindrical body, wherein the first end of the electrical conductor is electrically connectable to an initiator module for the perforation tool and the second end of the electrical conductor is electrically connectable to an initiator module for the perforation tool and to a charge module for the perforation tool.

Other embodiments described herein provide a bulkhead member for a perforation tool, the bulkhead member comprising a cylindrical body made from a structurally strong material the cylindrical body having a first end, a second end opposite the first end, and a central passage formed along an axis thereof from the first end to the second end; an electrical conductor disposed in the passage along the axis and having a first end with a rounded prong that extends into a socket formed in the first end of the cylindrical body, and a second end that has an electrical coupling protruding from the second end of the cylindrical body, wherein the first end of the electrical conductor is electrically connectable to an initiator module for the perforation tool and the second end of the electrical conductor is electrically connectable to an initiator module for the perforation tool and to a charge module for the perforation tool; and an insulating member disposed in the central passage between the cylindrical body and the electrical conductor.

Other embodiments described herein provide a method of downhole processing, comprising positioning a perforating charge in a perforating tool; positioning a booster charge adjacent to the perforating charge; deploying the perforating tool in a well; and activating the perforating charge by directly transferring ballistic energy from the booster charge to the perforating charge.

Other embodiments described herein provide a method of downhole processing, comprising positioning a plurality of perforating charges in a perforating tool; positioning a plurality of booster charges adjacent to the perforating charges, each booster charge adjacent to a corresponding perforating charge; deploying the perforating tool in a well; activating a first booster charge of the plurality of booster charges; activating each booster charge by direct transfer of ballistic energy from a neighboring booster charge; and activating each perforating charge by direct transfer of ballistic energy from the corresponding booster charge.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1A:
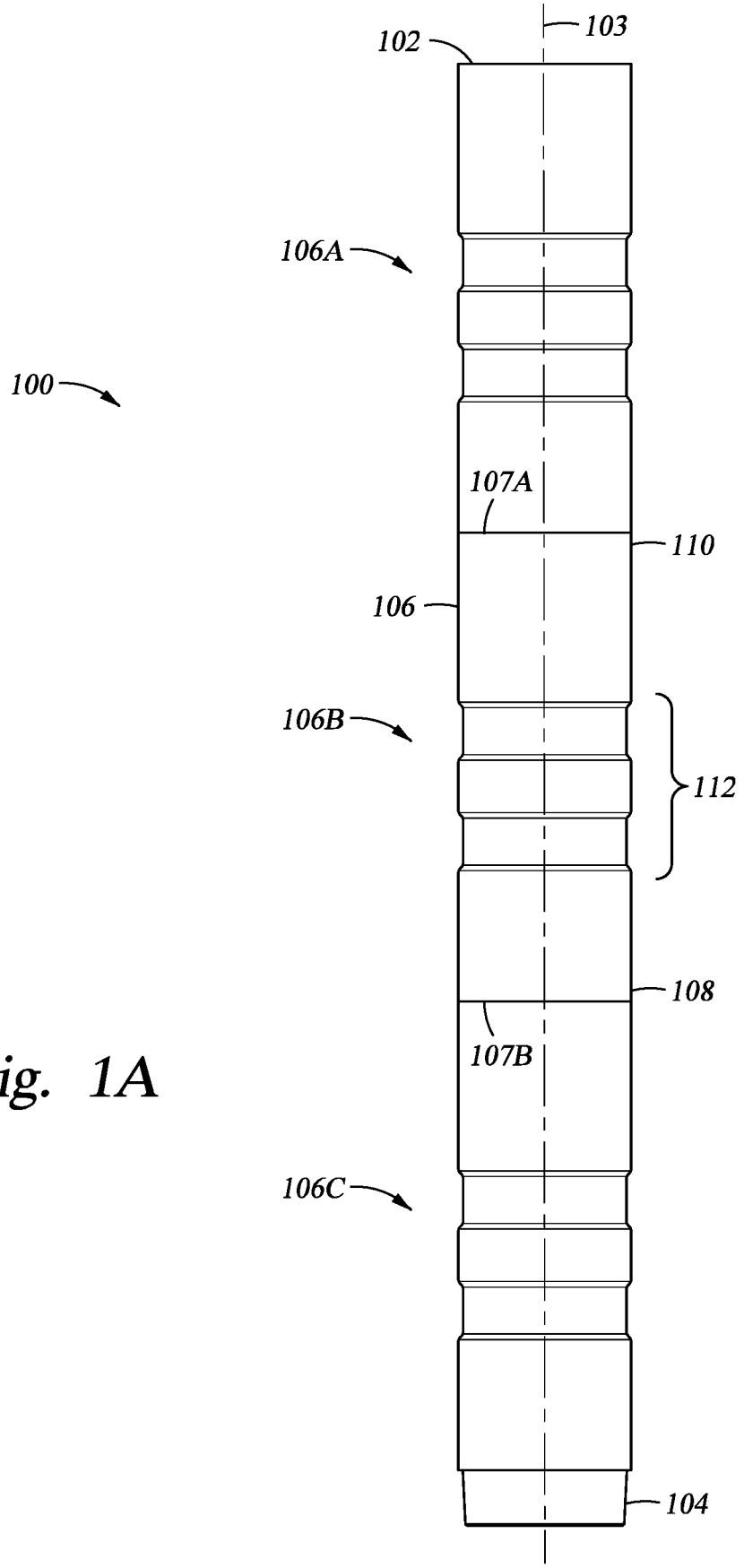
FIG. 1A is a side view of a perforation tool according to one embodiment.

The modular perforation tools described herein are configured to be transportable in a single parcel, and to be scalable to any desired degree in the field. The tools described herein are also feature configurable discharge directionality and spacing. FIG. 1A is a side view of a perforation tool 100 according to one embodiment. The perforation tool 100 is configured to integrate into a tool for use in a well bore. The perforation tool 100 has a first end 102 and a second end 104 opposite from the first end 102. Each end is configured to attach to a drill string, by threaded connection, bolting, or other attachment mode. The apparatus shown in FIG. 1A displays an outer housing 106, which is in three identical segments 106A, 106B, and 106C, which are fit together at joints 107A and 107B. Each of the segments 106A, 106B, and 106C has an initiator end 108 and a bulkhead end 110. The initiator end 108 can house an initiator and the bulkhead end 110 can house a bulkhead, each of which is further described below. Each segment 106A, 106B, and 106C also has a charge region 112, generally between the initiator end 108 and the bulkhead 110, which houses shaped charges that perform the perforation of the well bore when activated. The outer housing 106 of the perforation tool has a generally cylindrical shape with circular cross-section at most locations along its length, and a central cylindrical axis 103. Thus, the initiator end 108 of each segment 106A, 106B, and 106C encloses a cylindrical interior in which a cylindrical object can be disposed. Likewise, the bulkhead end 110 of each segment 106A, 106B, and 106C encloses a cylindrical interior, and the charge region 112 also encloses a cylindrical interior.

Figure 1B:
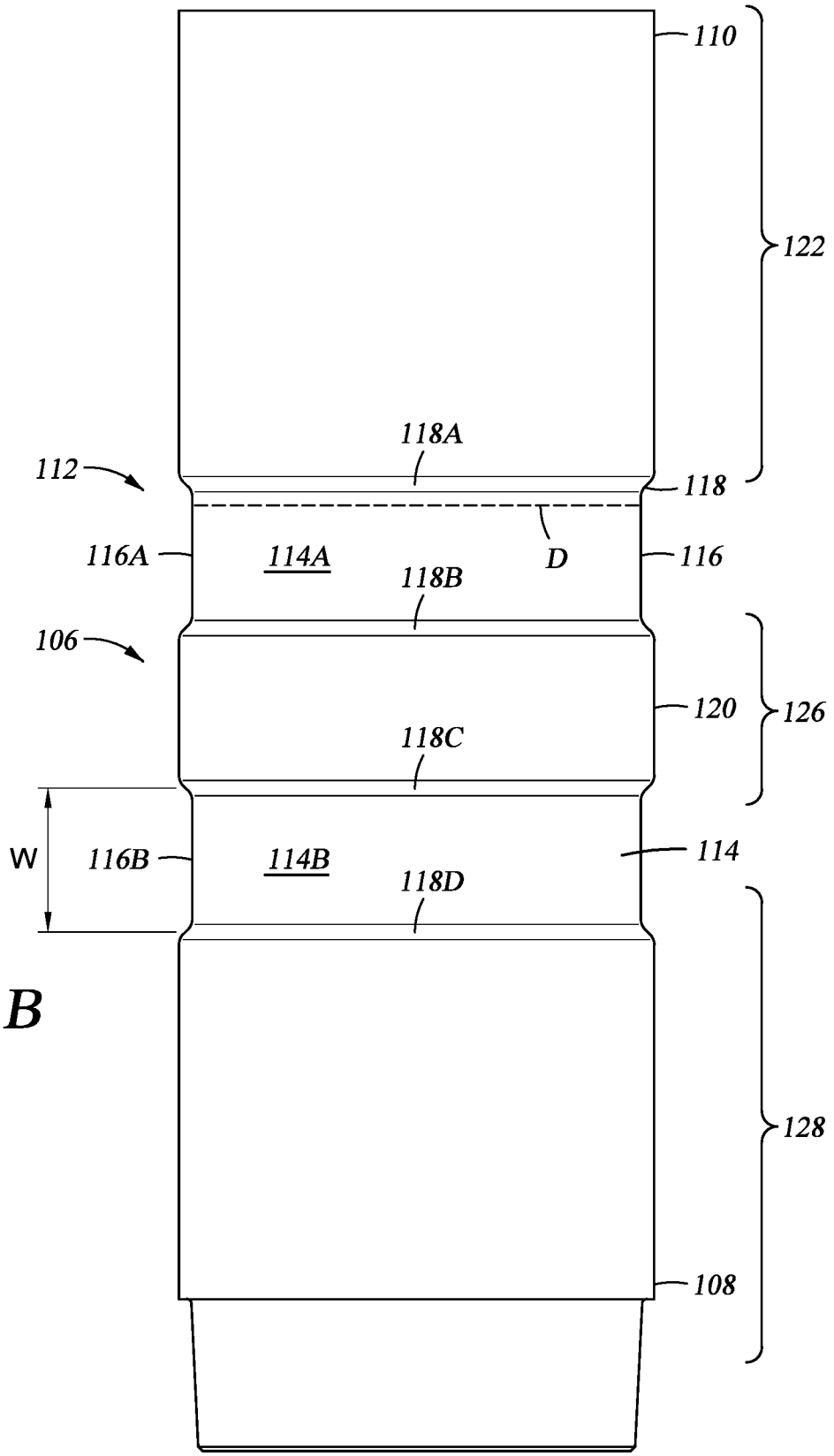
FIG. 1B is a detailed view of a portion of the perforation tool of FIG. 1A.

FIG. 1B is a detail view of a portion of the perforation tool 100 of FIG. 1A. This view shows one of the segments 106A, 106B, 106C, of the outer housing 106. The outer housing 106 has a wall thickness that varies according to the function of the particular location in the outer housing 106, some parts thicker and some parts thinner. In particular, each charge region 112 features two perforation grooves 114, a first perforation groove 114A and a second perforation groove 114B, which are thin portions of the outer housing 106 configured to admit a discharge impulse of gas from one or more shaped charges located in the interior of the charge region 112 adjacent to each perforation groove 114. Each perforation groove 114 is a band formed around the circumference of the outer housing 106, generally with wall thickness that is less than a wall thickness at another location in the housing. The band proceeds around the circumference of the outer housing 106 in an azimuthal direction, generally along a plane transverse to the central axis. Each perforation groove 114 has a flat central portion 116 and a sloped wall 118 on either side of the central portion 116 that connects the central portion 116 to an outer wall 120 of the outer housing 106. The first perforation groove 114A has a first central portion 116A, a first sloped wall 118A and a second sloped wall 118B, opposite from the first sloped wall 118A. The second perforation groove 114B has a second central portion 116B, a third sloped wall 118C and a fourth sloped wall 118D, opposite from the third sloped wall 118C. The sloped walls 118 may be flat or curved, and may form an angle with the central portion of 20-80 degrees. In this case, the sloped walls 118 all form an angle of 45 degrees with the respective central portions 116.

The central portions 116 of the perforation grooves 114 have the same width along the axial direction of the perforation tool 100. The width of the central portions 116 is selected to provide a window for discharge gas penetration of the central portion tailored to result in a discharge impulse, upon charge activation, that travels from the central portion into the well bore wall a desired distance with a desired dispersion profile. If the internal diameter of the outer housing 106 at the central portion 116 is D and the width of the central portion 116 is W, a ratio D/W is general from about 1 to about 100, such as from about 2 to about 10, for example about 3.

Here, there are two perforation grooves 114, but the outer housing 106 can have any desired number of perforation grooves 114, as will be further explained below due to the modularity of the perforation tool 100. A minimum spacing between the perforation grooves 114 is generally set by interior structures of the perforation tool 100. Here, the spacing between the perforation grooves 114 is about the same as the width of the central portions 116. Each segment 106A, 106B, and 106C of the outer housing 106, in this case, has a bulkhead region 122 extending from the bulkhead end 110 of the segment to the first sloped wall 118A of the first perforation groove 114A, a first central portion 116A extending from the first sloped wall 118A to a second sloped wall 118B of the first perforation groove 114A, opposite the first central portion from the first sloped wall 118A, a spacing region 126 extending from the second sloped wall 118B of the first perforation groove 114A to the third sloped wall 118C of the second perforation groove 114B, a second central portion 116B extending from the third sloped wall 118C to the fourth sloped wall 118D, opposite the second central portion 116B from the third sloped wall 118C, and an initiator region 128 extending from the fourth sloped wall 118D to the initiator end 108 of the segment.

Figure 1C:
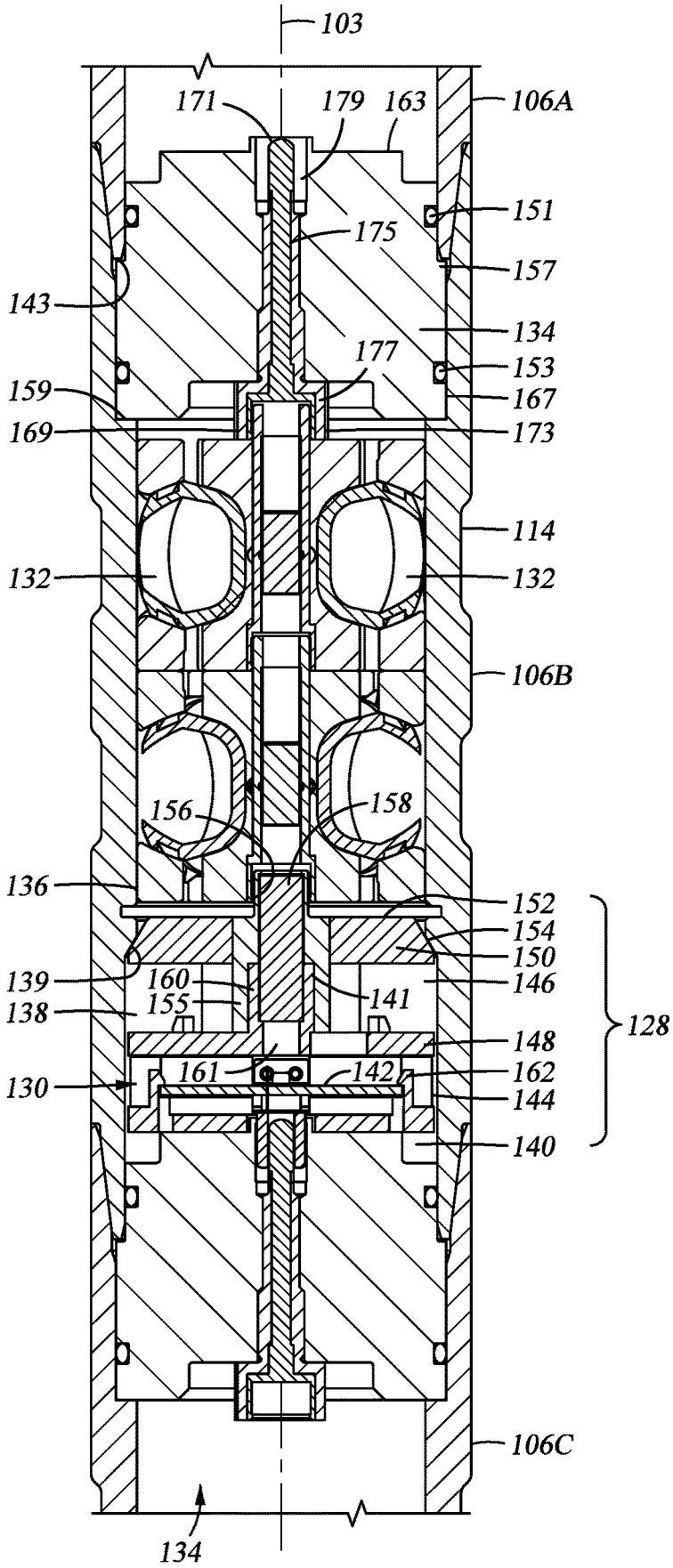
FIG. 1C is a cross-sectional view of a portion of the perforation tool of FIG. 1A.

FIG. 1C is a cross-sectional view of the perforation tool 100 of FIG. 1A. The outer housing 106 of the perforation tool 100, in this case, has three segments 106A, 106B, and 106C, as mentioned above. The first and third segments 106A and 106C are shown here largely empty in order to present the internal wall structure of the outer housing 106 clearly. The second segment 106B mainly features the internal structures of the perforation tool 100.

The perforation tool 100 includes an initiator module 130, a plurality of charge modules 132, in this case two charge modules 132 matched with the number of perforation grooves 114 in the outer housing 106, and a bulkhead member 134. Two bulkhead members 134 are shown in the apparatus of FIG. 1C. The charge modules 132 are arranged between a bulkhead member 134 and the initiator module 130. The initiator module 130 is a cylindrical module with an outer radius substantially the same as an inner radius of the outer housing 106 at the initiator region 128.

The wall of the outer housing 106 at the initiator region 128 has a first section 136, a second section 138, and a third section 140. The first section 136 starts at the initiator end 108 of the outer housing 106 and extends to the second section 138. The second section 138 is between the first section 136 and the third section 140. The inner diameter of the outer housing 106 tapers in the first section 136 from a first diameter at an end of the first section 136 to a second diameter at the second section 138. The first diameter is less than the second diameter. The tapered portion of the inner wall of the outer housing 106 provides a tapered surface 139 for engaging with the initiator module 130.

The initiator module 130 comprises a circuit plate 142 disposed in a container 144. The container 144 comprises a first member 146 and a second member 148. The first and second members 146 and 148 can be separated to extract the circuit plate 142 from the container 144. The initiator module 130 has a generally cylindrical shape with a first end 152 and a second end 153. The first member 146 has a contact ring 150 at the first end 152. The contact ring 150 has a tapered surface 154 that matches the tapered wall of the outer housing 106 in the first section 136 of the initiator region 128 thereof. The tapered surface 154 of the contact ring 150 has an outer radius that matches the inner radius of the wall of the outer housing 106 in the first section 136, the outer radius linearly declining toward the first end 152 such that the tapered surface 154 contacts the tapered wall of the outer housing 106 in the first section 136. The outer radius can generally have any declining profile that matches with the inner radius of the wall of the outer housing 106, such as curved or angled. It should be noted that, instead of providing tapered surfaces for engagement of the contact ring 150 with the wall of the outer housing 106, the wall of the outer housing 106 could have a shelf extending from a right cylindrical wall, and the first member could have a contact ring, or contact portion, with a straight surface to engage with the wall and an end to contact the shelf.

The first member 146 of the container 144 has a central opening 156 that accommodates a detonator 158 that is disposed in the initiator module 130, and when so disposed, protrudes through the central opening 156. The second member 148 includes a central plug 160 that is aligned with the central opening 156 and holds the detonator 158 in position. The second member 148 also includes a plurality of clips 162 that hold the circuit plate 142 in a position transverse to the central axis 103. The central plug 160 can be formed integrally with the second member 148, or may be a separate member that engages with the rest of the second member 148 and with the detonator 158 and the first member 146.

The first member 146 has a central socket 155 that defines the central opening 156 and extends along an axis of the initiator module 130. The central plug 160 fits within the central socket 155 to assemble the first member 146 and the second member 148. The central plug 160 and central socket 155 may be electrically conductive to provide electrical coupling from the initiator module 130 to the charge module 132, as further described below. Alternately, one or both of the central plug 160 and the central socket 155 may be non-conductive materials, for example polymer, with conductive members such as wires or rods disposed therein, for example in grooves in the surface of either or both of the central plug 160 and the central socket 155, or disposed within the body of either or both of the central plug 160 and the central socket 155.

The central socket 155 has a nub 145 that extends slightly beyond the end of the detonator 158 and encloses the detonator 158. The central socket 155 has three sections, a first section that engages with the central plug 160, a second section that holds the detonator 158, and a third section defined by the nub 145. Each section is cylindrical in profile. The first section has an inner diameter larger than an outer diameter of the detonator 158 to accommodate the central plug 160. The second section has an inner diameter substantially the same as the outer diameter of the detonator 158 in order to hold the detonator 158. Here, the first and second sections have the same outer diameter, but the outer diameter of the two sections could be different. The third section, defined by the nub 145, has an inner diameter substantially the same as the outer diameter of the detonator 158, and an outer diameter less than the outer diameter of the first and second sections. The nub 145 has a hollow end to provide fluid coupling through the end of the nub 145 for ballistic coupling to a charge module 132. The nub 145 fits within an electrical coupling of a charge module 132, as further described below, to provide electrical coupling to the charge module 132.

Here, no wires are shown for connecting the detonator 158 to electricity. The detonator 158 may receive electrical energy by contact with the central plug 160, for example if the detonator 158 has electrical contacts built in. Alternately, the detonator 158 may have wires. In this case, the wires are disposed through a central opening 161 of the second member 148 to make electrical connection with contacts of the circuit plate 142.

Figure 1D:
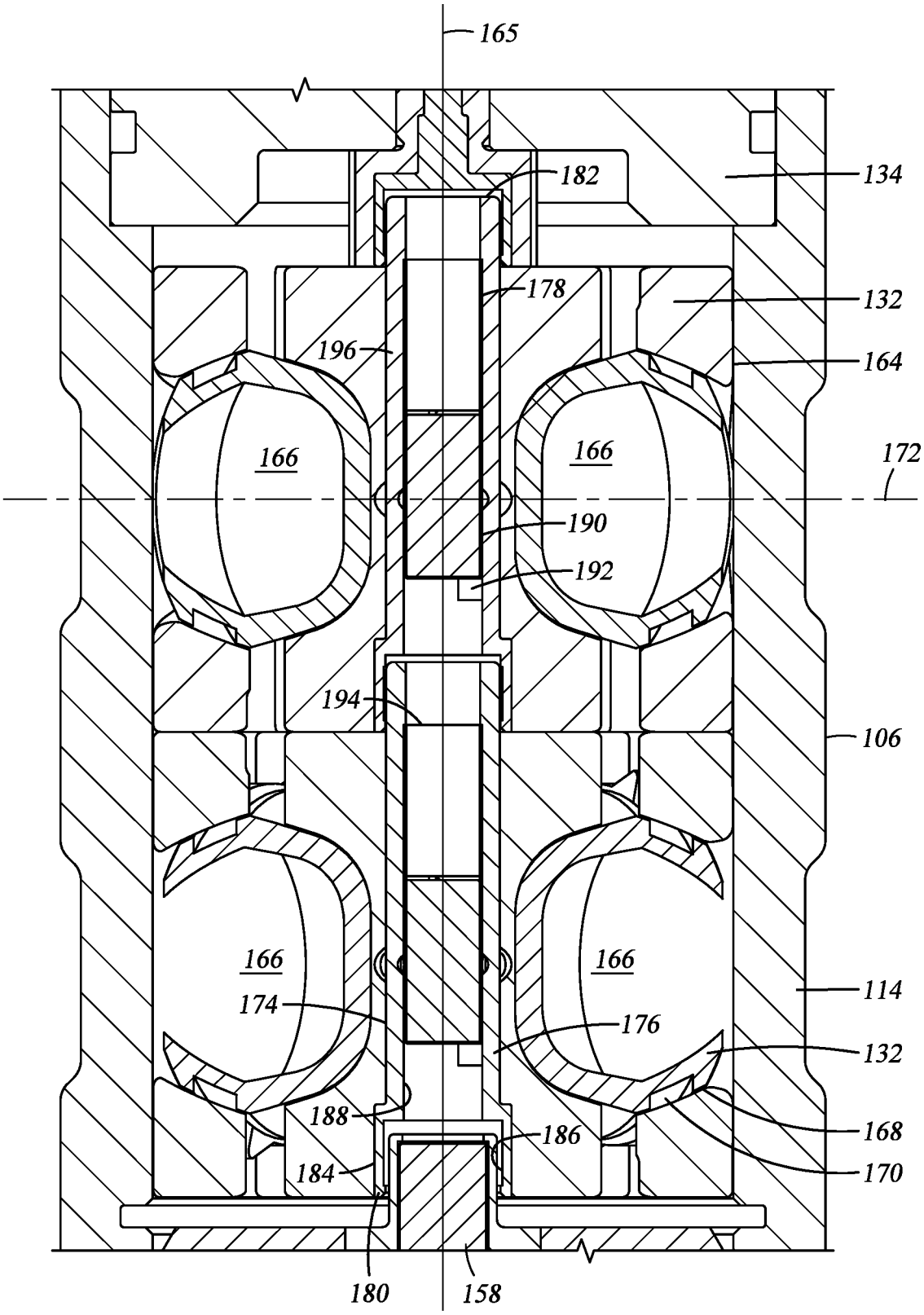
FIG. 1D is a more detailed cross-sectional view of a portion of the perforation tool of FIG. 1A.

FIG. 1D is a cross-sectional view of the charge modules 132 of the perforation tool 100. Each charge module 132 includes a frame 164 housing a plurality of shaped charges 166, each shaped charge disposed in a liner 168 that engages with the frame 164. Each frame 164 has a cylindrical shape with a central axis 165 aligned with the central axis 103 of the perforation tool 100 when the frames 164 are installed in the perforation tool 100. The liners 168 are disposed in openings 170 of the frame 164, the openings 170 arranged along a plane 172 perpendicular to the central axis 103. The plane 172 is here represented as a dotted line, since the view of FIG. 1D shows the plane edge-on. Each frame 164, in this case, has three such openings 170 spaced 120° apart around the azimuth of the frame 164. The liners 168 are cup-shaped to fit the shape of the charges. The frames 164 are positioned in the interior of the outer housing 106 such that the openings 170, liners 168, and charges are positioned adjacent to a perforation groove 114 of the outer housing 106. Depending on the size of the charges to be used, the frames 164 can be configured to hold any convenient number of charges in openings spaced uniformly around the azimuth of the frame. Thus, two, three, four, five, or more charges can be positioned in a frame similar to these frames 164 by configuring the openings of the frames.

The frames 164 are made of a polymer material such as polypropylene, polyurethane, or another strong polymer material. The frames 164 can be made by molding, sculpting (for example laser scribing), or 3D printing. As shown in FIGS. 1B-1D, the frames 164 are stackable such that any number of frames 164 can be disposed in a perforation tool. Usually the number of frames 164 disposed in the perforation tool will be consistent with the number of perforation grooves 114 in the outer housing 106, but a greater or lesser number of frames 164 can, in principle, be disposed in the outer housing 106. The frames 164 are also rotatable within the outer housing 106 to orient the discharge direction in any desired way. The perforation grooves 114, which proceed completely around the housing 106, generally allow orienting a shaped charge in any azimuthal direction. The perforation grooves 114 are equally susceptible to penetration at every azimuth by the shaped charges located within the frames 164 adjacent to the perforation grooves 114. Rotatability of the frames 164 supports pointing the shaped charges held by the frames 164 in any direction within the perforation tool, without limitation. In this way, the housing 106 of the perforation tool 100 does not need to be positioned or oriented according to a rotation angle to allow jets from the shaped charges to penetrate in a desired direction.

Each of the frames 164 has a central passage 174 axially oriented in the center of the frame 164. An electrical conductor 176 is disposed through the central passage 174 of each frame 164. In this case, each frame 164 has an electrical conductor 176 disposed in the central passage 174 thereof. Each electrical conductor 176 contacts an inner wall 178 of the passage 174, but a space can be provided between the electrical conductor 176 and the inner wall 178 in some cases. Such space can be a continuous annular space, or may be discontinuous, if desired.

Each electrical conductor 176 has a first end 180 and a second end 182 opposite the first end 180. The first end 180 has a coupling 184. The coupling 184 has a first diameter and the rest of the electrical conductor 176 has a second diameter. In this case, the first diameter is greater than the second diameter. The coupling can receive a connection portion of another module, such as the initiator module 130 or another frame 164. The second end 182 of each electrical conductor 176 protrudes beyond the frame 164, providing a connection that can connect the frame 164 to another frame 164, an initiator module 130, or a bulkhead member 134. When the charge modules 132 and initiator module 130 are installed in the perforation tool 100, the coupling 184 of a frame 164 receives the portion of the detonator 158 that protrudes through the first member 146 of the initiator module 130. Here, the central passage 174 has a first section 186 with a first diameter and a second section 188 with a second diameter. The first diameter, in this case, is greater than the second diameter. Here, the second diameter of the second section 188 of the central passage 174 is substantially the same as the outer diameter of the electrical conductor 176, while the first diameter of the central passage 174 is substantially the same as an outer diameter of the coupling 184. Thus, an exterior surface of the coupling 184 contacts the first section 186 of the central passage 174 and the rest of the electrical conductor 176 contacts the second section 188 of the central passage 174 such that there is essentially no space between the electrical conductor 176 and the central passage 174. The coupling 184 in this case has a tapered outer surface where the coupling 184 joins the rest of the electrical conductor 176. The tapered outer surface of the coupling contacts a similarly tapered portion of the inner wall 178 of the central passage 174 that joins the first section 186 and second section 188 of the central passage 174. As noted above, this construction allows for space to be provided between the electrical conductor 176 and the second section 188 of the central passage 174, if desired.

A capsule 190 is positioned within the electrical conductor 176 for each frame 164 adjacent to the openings 170 of the frame, and adjacent to the shaped charges 166. The capsule 190 is made of a combustible material that provides an ignition source for the shaped charges. Unlike conventional boosters used in downhole tools, the capsule 190 has no direct physical connection to an energy source such as a detonator cord. The capsule 190 is merely a shaped volume of combustible material, perhaps contained in a wrapping, that fits within the electrical conductor 176. The capsule 190 is, thus, wireless. The capsule 190 is slipped into the electrical conductor 176 before the frame 164 is disposed in the container 144. Here, the electrical conductor 176 has a ridge 192 at one end of the electrical conductor 176 to aid in dependable placement of the capsule 190 with respect to the shaped charges. In this case, the ridge 192 is located at the second end 182 of the electrical conductor 176, but the ridge 192 could be positioned near the first end 180 of the electrical conductor 176.

To hold the capsule 190 in place inside the electrical conductor 176, a restraint 194 is positioned inside the electrical conductor 176 at a desired location. The restraint 194 can be a removable member, such as a snap ring, or a retractable member, which can extend around the entire circumference of the electrical conductor 176 or partway around the circumference. In any event, the restraint 194 can be removed or repositioned to allow placement of the capsule 190 between the restraint 194 and the ridge 192. In FIG. 1D, the capsule 190 is smaller than the space between the ridge 192 and the restraint 194.

In other embodiments, the capsule 190 may be sized to extend substantially from the first end 180 to the second end 182 of the electrical conductor 176. In such cases, the capsule 190 can be held in place between the ridge 192 of a first electrical conductor 176 and the ridge 192 of a second electrical conductor 196. Thus, referring to FIG. 1D, a capsule 190 might extend from a ridge 192 at the second end 182 of a first electrical conductor 176 to the first end 180 of the first electrical conductor 176, and may be held in place between the ridge 192 of the first electrical conductor 176 and the second end 182 of a second electrical conductor 176 disposed against the first end 182 of the first electrical conductor 176. Use of a separate restraint 194, as shown in FIG. 1D, allows for use of smaller capsules 190.

An opening in the electrical conductor 176, adjacent to a similar opening in the inner wall 178 of the central passage 174, provides fluid coupling from the interior of the electrical conductor 176 through the frame 164 to the shaped charges 166. Each electrical conductor 176 provides fluid coupling along the length thereof from the detonator 158 to the capsules 190. The electrical conductor 176 thus provides electrical and ballistic coupling from the initiator module 130 to the shaped charges 166. When the circuit plate 142 provides an electrical impulse, the electrical impulse is transmitted to the detonator 158 and to a first electrical conductor 176 of a first frame 164 adjacent to the initiator module 130. The electrical impulse is transmitted by the first electrical conductor 176 through the first frame 164 to the capsule 190 of the first electrical conductor 176. The detonator 158 combusts upon application of the electrical discharge from the circuit plate, and the ballistic discharge from the detonator 158 travels down the first electrical conductor 176 to the first capsule 190, which combusts. Discharge from the first capsule 190 discharges the shaped charges 166 adjacent to the first capsule 190. Discharge from the first capsule 190 also travels down the first electrical conductor 176 to the second end thereof, along with the electrical impulse from the firing of the circuit plate 142. The second end of the first electrical conductor is mated with the coupling 184 of a second electrical conductor 176 of a second frame 164, providing fluid and electrical communication from the first electrical conductor 176 to the second electrical conductor 176. The ballistic discharge, and electrical impulse, travel from the first electrical conductor 176 of the second electrical conductor 176, to the second capsule 190, which discharges and ignites the shaped charges adjacent to the second capsule 190. The discharge from the shaped charges 166 is configured to pierce the perforation grooves 114 of the outer housing 106 with enough energy to continue to the well bore and through the bore wall into the formation. In this way, any number of shaped charges 166 can be discharged using the structure of the perforation tool 100 shown in FIGS. 1A-1D.

The structures described above allow for activation of perforating charges in a perforating tool without use of wires to transfer energy. The detonator is activated in the initiator module by electrical stimulation, but then a direct transfer of ballistic energy from the detonator activates the first capsule, which in this case is a booster charge. Ballistic energy transfer from activation of the first booster charge activates a first perforation charge adjacent to the first booster charge. Ballistic energy transfer from activation of the first booster charge also activates a second booster charge adjacent to the first booster charge. Ballistic energy transfer from the second booster charge, in turn, activates a second perforation charge adjacent to the second booster charge. In this way, an entire perforation gun made up of an number of perforating charges can be activated essentially wirelessly. The only wired connection in such a structure is from the firing circuit of the circuit plate to the detonator in the initiator module. In the event a wireless initiator module is used with the structures above, the entire perforating tool is wireless.

The circuit plate 142 is also electrically connected to the electrical conductor 176, which provides electrical power through the frames 164. The initiator module 130 includes a connector 141 with a central passage to receive the detonator 158 therein. The connector 141 protrudes from the initiator module 130 like the detonator 158 and electrically couples to the coupling 184 of the electrical conductor 176. The plug 160 inserts into the connector 141, and the detonator 158 held in the plug 160 passes through the connector 141 and protrudes into the electrical conductor 176 when the initiator module 130 is coupled to the charge module 132.

The bulkhead member 134 is a dense structurally strong object made, for example, of steel. The bulkhead member 134 has a cylindrical body 147 in this case, but in general is shaped to match the cross-sectional profile of the outer housing 106. The bulkhead member 134 is disposed in the outer housing 106 in the bulkhead region 122 thereof. As shown in FIG. 1C, the bulkhead member 134 is inserted into the bulkhead region 122 of the second segment 106B of the outer housing 106 such that a first end 167 of the bulkhead member 134 couples with the protrusion of the second end 182 of the electrical conductor 176 by a bulkhead conductor 177 inserted through a central passage 175 of the bulkhead member 134 that extends from the first end 167 to a second end 163 of the cylindrical body 147 of the bulkhead member 134. As noted above, the cylindrical body 147 of the bulkhead member 134 is made of a structurally strong material, which may be electrically conductive or non-conductive. The bulkhead conductor 177 has a first end 173 and a second end 171 opposite from the first end 173. The first end 173 has a coupling 169 that protrudes at the first end 167 of the bulkhead member 134 and receives an electrical conductor from another module, such as the second end 182 of the electrical conductor 176 of the frame 164 or the connector 141 of the initiator module 130 that protrudes from the initiator module 130. The second end 171 of the conductor 177 is a prong-like structure with a rounded tip extending into a socket 179 at the second end 163 of the bulkhead member 134. The socket 179 is configured to couple only to the second member 148 of the initiator module 130 such that the circuit plate 142 installed in the second member 148 is substantially protected from detonation of the shaped charges in the charge module 132. In FIG. 1C, two bulkhead members 134 are installed at either end of the assembly to isolate the discharge of the charge modules 132.

The bulkhead member 134 is inserted into the housing 106 and abuts a ledge 159 of the outer housing 106 that marks a boundary between the bulkhead region 122 of the outer housing 106 and the charge region 112. The bulkhead member 134 is a cylindrical object, in this case, but is generally shaped according to the profile of the housing 106. The bulkhead member 134 has a retention shelf 157 that engages with an edge 143 of the first segment 106A of the outer housing 106, which modularly engages with the second segment 106B, as described above. The edge 143 of the outer housing 106 securely captures the bulkhead member 134 between the edge 143 of one housing segment and the ledge 159 of another housing segment, holding the bulkhead member 134 securely in the bulkhead region 122 of the housing segment.

A first seal is disposed in a first seal groove 153 of the bulkhead member 134 near the first end 167 thereof and between the bulkhead member 134 and the second housing segment 106B. A second seal is disposed in a second seal groove 151 disposed between the first housing segment 106A, near the edge 143, and the bulkhead member 134. The first seal groove 153 is disposed in a side wall of the bulkhead member 134 that extends from the retention shelf 157 to the first end 167 of the bulkhead member 134 and has a first diameter. The second seal groove 151 is disposed in a side wall of the bulkhead member 134 that extends from the retention shelf 157 toward the second end 163 of the bulkhead member 134 and has a second diameter. The retention shelf 157 is thus located between the first seal groove 153 and the second seal groove 151, and the first and second seal grooves 153 and 151 provide sealing between the bulkhead member 134 and respective first and second housing segments 106A and 106B. The first diameter of the side wall of the bulkhead member 134, between the first end 167 and the retention shelf 157, is larger than the second diameter of the side wall, between the retention shelf 157 and the second end 163, such that the retention shelf 157 can provide secure positioning of the bulkhead member 134 in the outer housing 106.

The bulkhead member 134 has a recess 149 formed in the first end 167 thereof. The central passage 175 of the bulkhead member 134 is formed at a central area of the recess 149. The recess 149 facilitates inserting and removing the conductor 177 in the central passage. The second end 163 of the bulkhead member 134 is designed, overall, to abut the initiator module 130, while the first end 167 of the bulkhead member 134 is designed to interface with a charge module 132. Here, the first end 167 of the bulkhead member 134 does not abut the charge module 132, since the conductors of the two components protrude and engage without the modules abutting. By reducing the distance the conductors of the two modules protrude, the charge module 132 could be disposed close enough to the bulkhead member 134 to abut the first end 167 of the bulkhead member 134. It should be noted that the bulkhead member 134 is radially symmetric, so rotational orientation of the bulkhead member 134 in the outer housing 106 does not affect its operation.

Figure 2A:
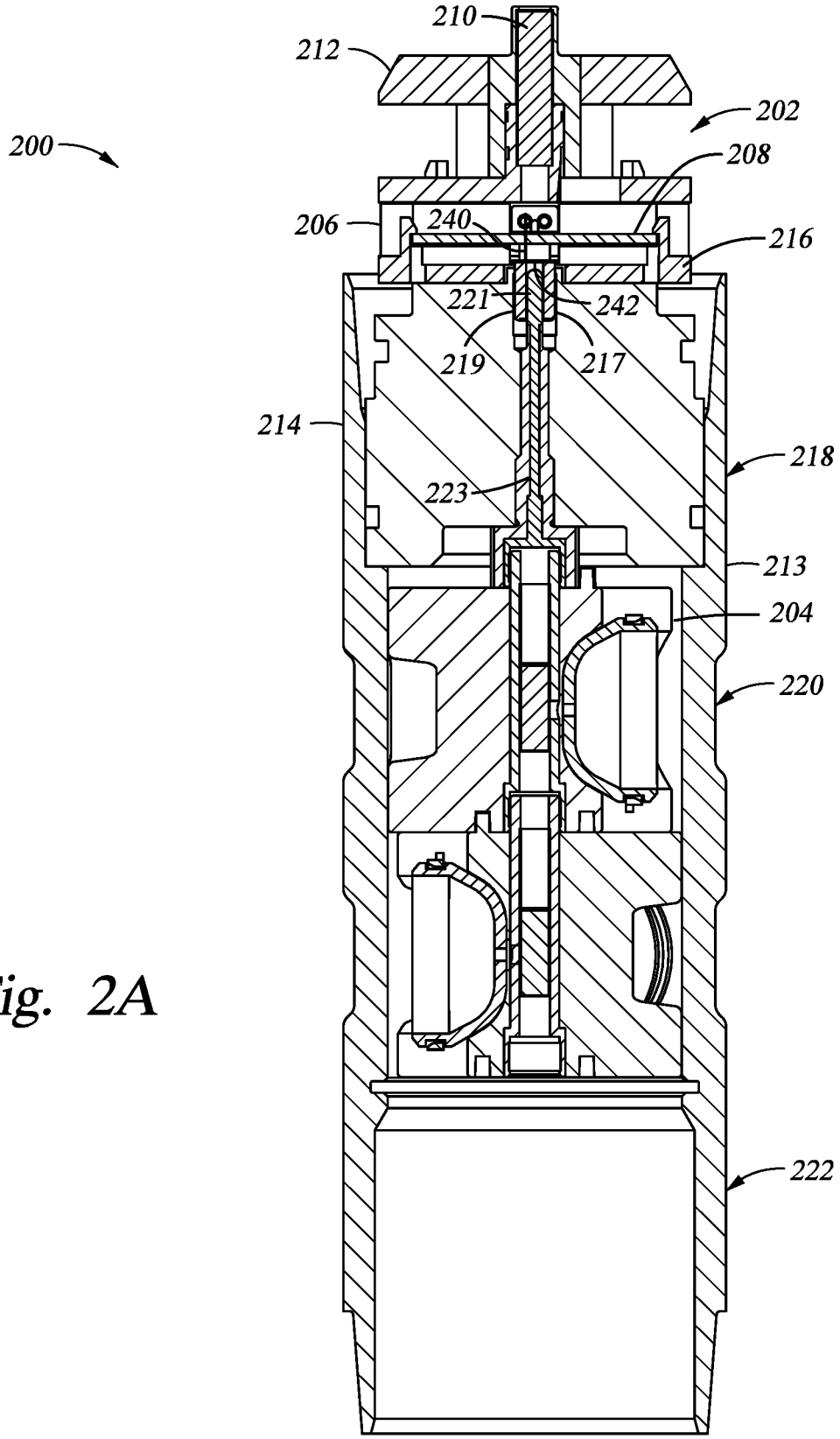
FIG. 2A is a cross-sectional view of a perforation tool in a transportation configuration according to another embodiment.

FIG. 2A is a cross-sectional view of a perforation tool 200 in a transportation configuration according to another embodiment. The perforation tool 200 packages an initiator module 202 with a charge module 204 in one package for shipment. The initiator module 202 is like the initiator module 130 of FIGS. 1C-1D, with a two-piece container 206 housing a circuit plate 208 and a detonator 210. The detonator 210 is located at a first end 212 of the initiator module 202, and the initiator module 202 is coupled to a bulkhead member 214 at a second end 216 of the initiator module 202. The bulkhead member 214 is between the initiator module 202 and the charge module 204 in the perforation tool 200, with the detonator 210 spaced apart from the charge module 204, such that the perforation tool 200 can be shipped with detonator and charges in the same package, without the possibility of unintended ignition. An electrical connector 217 protrudes from the second end 216 of the initiator module 202 and engages with a socket 219 of the bulkhead member 214 with a bulkhead conductor 221 positioned in the socket 219 and extending through the bulkhead member 214. Here, the electrical connector 217 is cylindrical, but in other embodiments the electrical connector 217 may be prongs or brackets that engage with one or more similarly shaped sockets 219. The electrical connector 217 provides electrical continuity between the bulkhead member 214 and the initiator module 202. The bulkhead member 214 may be electrically conductive. In such cases, an insulating member 223 is disposed through the bulkhead member 214 between the cylindrical body 147 and the bulkhead conductor 221, thus preventing short circuiting through the bulkhead member 214. The insulating member 223 is disposed in the central passage 175 of the cylindrical body 147 (FIG. 1C), and in this case continuously lines the central passage 175. Thus, in this case, the insulating member 223 is a liner. In other cases, the insulating member 223 may be a spacer instead of, or in addition to, being a liner. In such cases, the insulating member 223 may be discontinuous or may have holes or openings that provide space between the cylindrical body 147 and the bulkhead conductor 221. In the event the bulkhead member 214 is not electrically conductive, the insulating member 223 can be omitted.

Figure 2B:
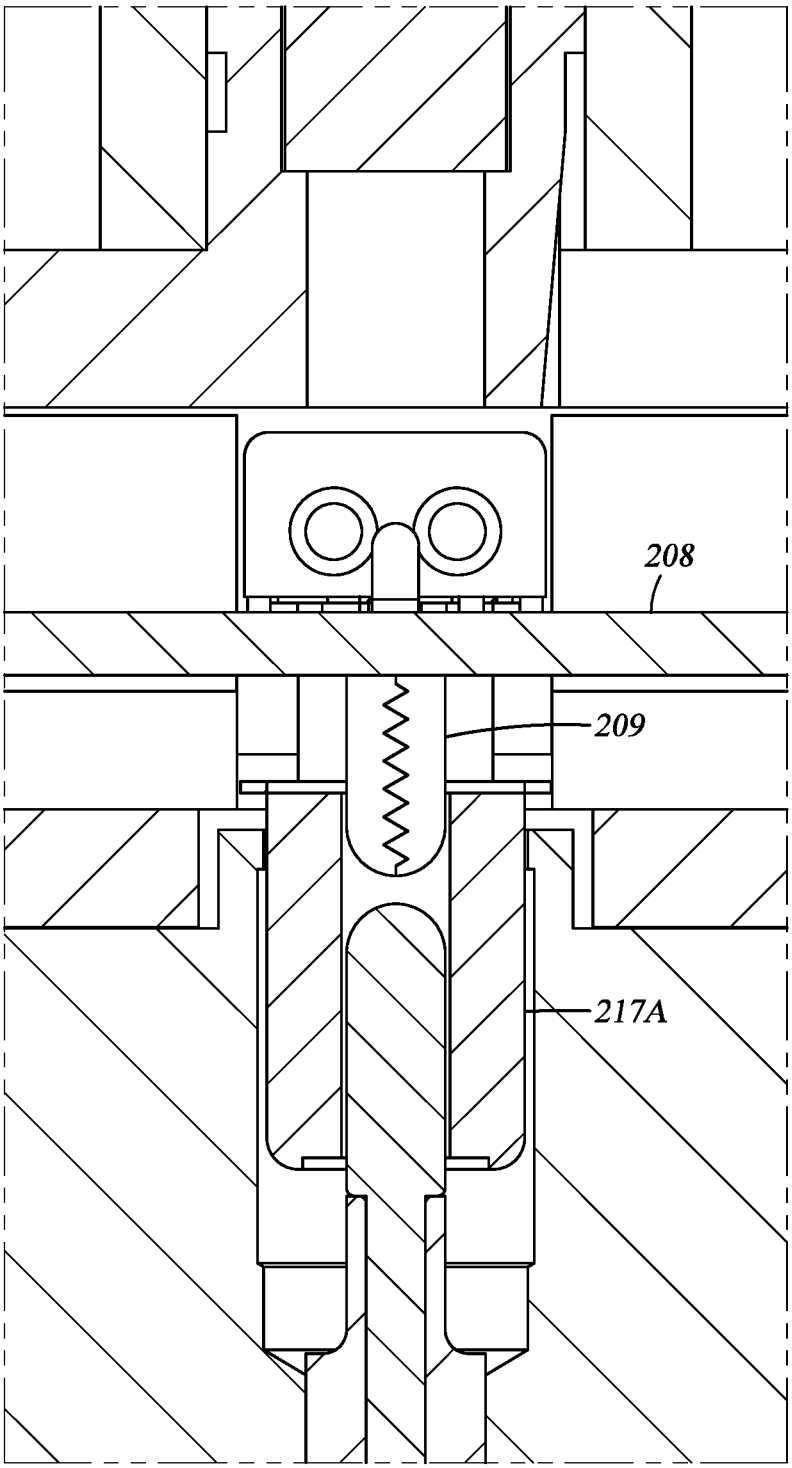
FIG. 2B is a detail view of a portion of a perforation tool, according to one embodiment.

The electrical connector 217 could be a separate member from the initiator module 202. In one case, the electrical connector 217 could be a electrical contact band that fits within the shaped socket 219. FIG. 2B is a detail view of a portion of a perforation tool, according to one embodiment. FIG. 2B shows an embodiment in which a electrical contact band 217A is disposed in the shaped socket 219 to provide electrical connection from the circuit plate 208 to the bulkhead conductor 221. The electrical contact band 217A is a generally cylindrical electrically conductive member that fits within the shaped socket 219 and provides electrical connection under a 360 degree rotation of members in electrical communication therewith. The electrical contact band 217A has an open middle so that the bulkhead conductor 221 can be inserted into the middle of the electrical contact band 217A. The electrical contact band 217A, in this case, specifically provides electrical connection with the bulkhead conductor 221 under any rotation of the bulkhead conductor 221.

In FIG. 2A, the circuit plate 208 is shown electrically connected to the connector 217 by a wire 240, optionally terminating in a contact pad 242 that connects with the connector 217. In FIG. 2B, an optional pogo pin 209 can be provided extending from the circuit plate 208 to provide a robust electrical connection from the circuit plate 208 to the connector 217 of FIG. 2A or the electrical contact band 217A of FIG. 2B. In FIG. 2B, electrical connection from the circuit plate 208 to the electrical contact band 217A is made at the ring end of the electrical contact band 217A facing the circuit plate 208 by providing a cylindrical pogo pin 209 with a tapered tip and a diameter larger than an inner diameter of the ring end of the electrical contact band 217A. Upon deploying the initiator module 202 with the charge module 204, the tapered tip of the pogo pin 209 nests in the ring end of the electrical contact band 217A, and the spring-loaded pogo pin 209 depresses to provide an engaging force between the pogo pin 209 and the ring end of the electrical contact band 217A, thus creating a robust electrical connection between the circuit plate 208 and the bulkhead conductor 221. While the pogo pin 209 of FIG. 2B is shown engaging with the electrical contact band 217A in the center of the ring end of the electrical contact band 217A, the electrical contact could be made using a pogo pin such as the pogo pin 209 at any convenient location between the circuit plate 208 and the bulkhead conductor 221 using wires and contact pads or recesses in any convenient configuration. An RCA connection can also be used in place of the pogo pin 209.

Here, the electrical contact band 217A is shown as a cylindrical member. The electrical contact band 217A may have solid cylindrical walls, or may have vertically slotted walls in some embodiments. In other embodiments, the electrical contact band 217A may have a generally cylindrical shape with a first diameter at the ends of the electrical contact band and a second diameter near a middle of the electrical contact band, where the second diameter is less than the first diameter, for example a cylindrical shape with a slight narrowing in the middle. Use of such a shape along with vertical slotting can provide a flexible and secure connection with the electrical contact band 217A.

There are two charge modules 204 in the perforation tool 200, but as described elsewhere herein, more or fewer charge modules 204 can be used. The charge modules 204, bulkhead member 214, and initiator module 202 are configured with an outer housing 213, which has a bulkhead region 218, a charge region 220, and an initiator region 222, similar to the outer housing 106, and segments thereof 106A, 106B, and 106C, described in connection with FIGS. 1A-1D. To prepare the perforation tool 200 for operation, an initiator module is inserted into the interior of the outer housing 213 in the initiator region 222, coupling the detonator 210 of the initiator module with the charge module 204. The initiator module 202 can be disconnected from the bulkhead member 214 and inserted into the initiator region 222. Alternately, an initiator module of another unit like the perforation tool 200 can be coupled at the initiator region 222, coupling two charge regions together in an extended perforation tool. The modularity and safe shipping configuration of the perforation tool 200 allows a plurality of such tools to be shipped to a field location and assembled with ease into an operational configuration.

Figure 2C:
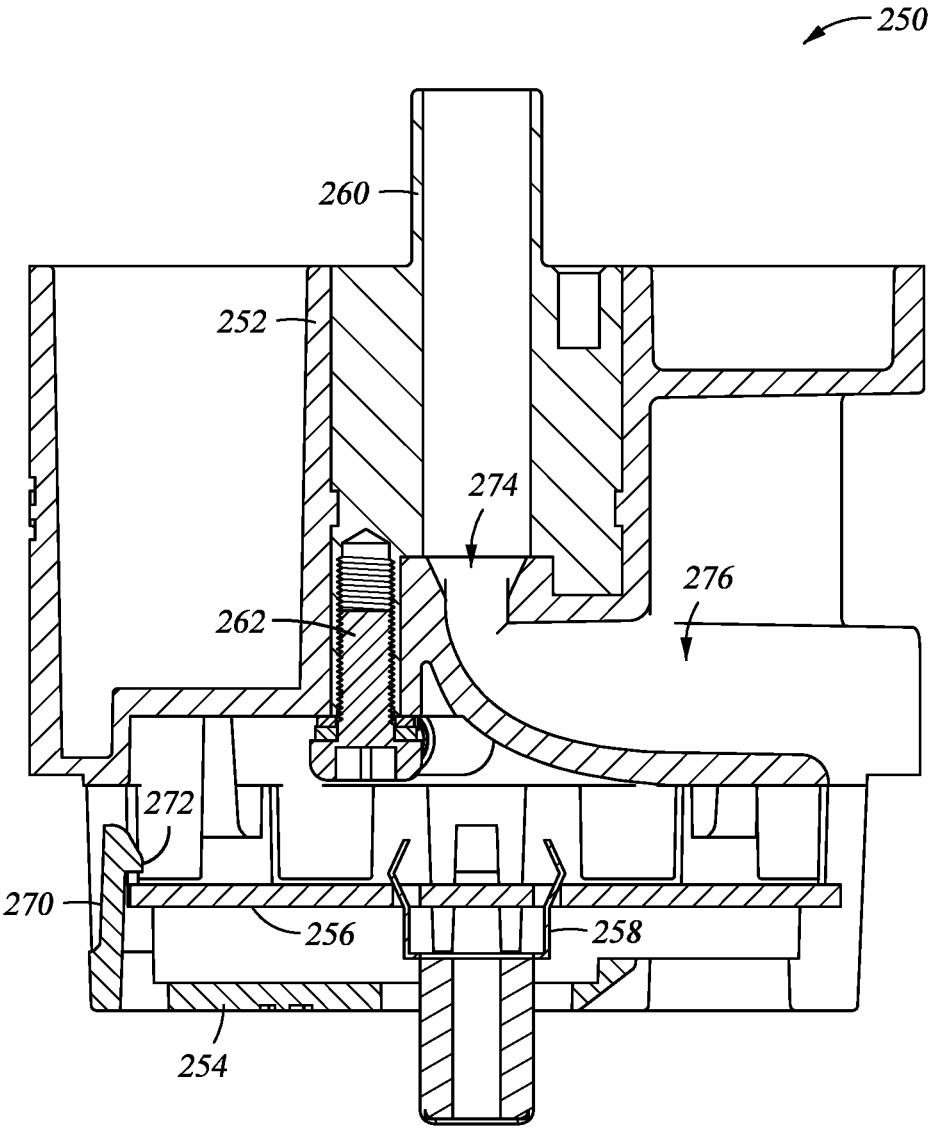
FIG. 2C is a cross-sectional view of an initiator module according to another embodiment.

FIG. 2C is a cross-sectional view of an initiator module 250 according to another embodiment. The initiator module 250 is adapted for use with a circuit plate of a different configuration. The initiator module 250 has a first member 252 that accommodates a central plug 260 that holds a detonator (not shown), similar to the central plug 160 of FIG. 1C. In this case, the central plug 260 is a separate member that is attached to the first member 252 by a fastener 262, in this case, a screw.

The initiator module 250 also has a second member 254, which contains a circuit plate 256, held to the second member 254 by circuit plate clips 258. Outer clips 270 of the second member 254 engage with recesses 272 of the first member 252 to releasably attach the first and second members 252 and 254 together.

In this case, the initiator module 250 is configured to accommodate wires to connect the detonator to contacts located at a periphery of the circuit plate 256. Here, the first member 252 has a central opening 274 to allow wires from the detonator to pass through the central opening 274 into a passage 276 of the first member 252. The central opening 274 has a flared entrance 275 to simplify feeding wires of the detonator through the central opening 274. The passage 276 includes a curved guide 278 that extends from the central opening 274 toward the second member 254 and radially outward away from the central opening 274, along a curved path, toward the periphery of the first member 252. The passage 276, with the guide 278, steers detonator wires to the periphery of the first member 252 to simplify connection of the wires to contacts at the periphery of the circuit plate 256.

Figure 3A:
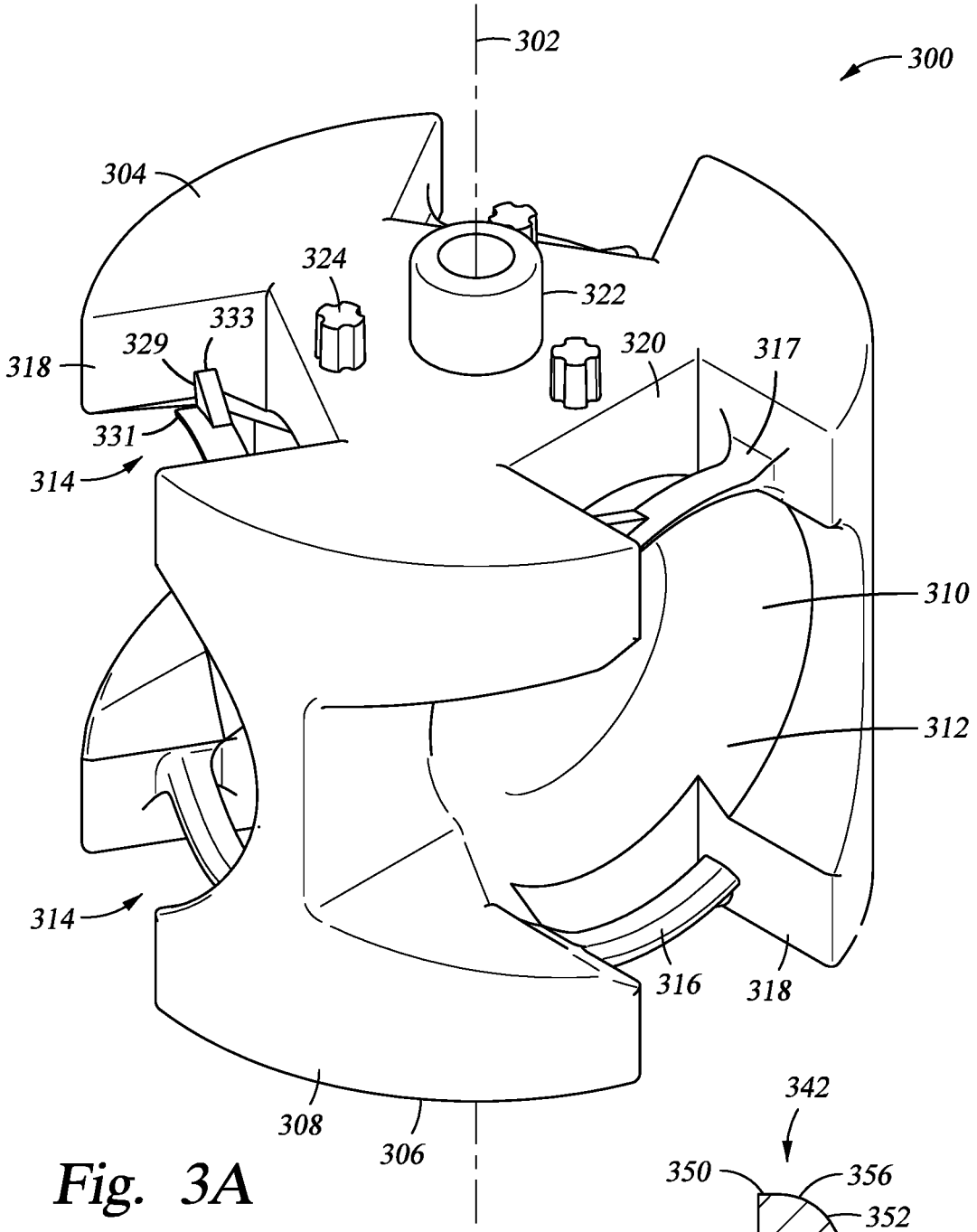
FIG. 3A is an isometric view of a charge frame according to another embodiment.

FIG. 3A is an isometric view of a frame 300 according to another embodiment. The frame 300 can be used as one of the frames 164 in the charge module 132 of the perforation tool 100 of FIGS. 1A-1D. The frame 300 has a generally cylindrical shape with a central axis 302. In this case, the frame 300 is a single unit with a first end 304 and a second end 306 opposite from the first end 304. The central axis 302 extends from the first end 304 to the second end 306. Each of the first end 304 and the second end 306 have a generally circular shape as the ends of the cylindrical shape of the frame 300.

A side 308 of the frame 300 connects the first end 304 to the second end 306. A plurality of recesses 310 are formed in the side 308. The recesses 310 are generally circular and extend into the side 308 toward the central axis 302 and have diameter that generally declines toward the central axis 302. Each recess 310 generally defines an outer wall 312 of the recess 310, which is a surface extending from the side 308 toward the central axis 302. The outer wall 312 maintains a generally circular cross-section while tapering in dimension toward the central axis 302. This outer wall 312 will generally take a shape that facilitates placement of charges in the recesses 310 that have shapes designed to project a jet of ballistic discharge radially outward from the central axis 302. The recesses 310 are generally arranged in a coplanar arrangement, where a plane defined by the centroids of the three recesses 310 is perpendicular to the central axis 302 of the frame 300.

Where the outer wall 312 of the recess 310 approaches the first end 304 and second end 306 of the frame 300, a notch 314 is provided in the side 308 of the frame 300 from the outer wall 312 of the recess 310 to the respective first end 304 or second end 306. The notch 314 provides a foundation for a restraint 316 that operates to secure a shaped charge in the recess 310. The restraint 316 extends from a side wall 318 of the notch 314 in a direction generally across the notch 314 toward the opposite side wall of the notch 314, which faces the side wall 318. The notch 314, in this case, has a rectangular profile that extends radially inward from the side 308 of the frame 300 toward the central axis 302. Each notch 314 thus has two side walls 318, which are substantially parallel, and a floor 320 connecting the two side walls 318 and perpendicular to both side walls 318. The floor 320 of each notch 314 is planar here, but could be curved in other embodiments. As noted above, each end of the frame 300, the first end 304 and the second end 306, has a notch 314, and the notches 314 at the two ends 304 and 306 are aligned in a direction parallel to the central axis 302. The two side walls 318 of each notch 314 are substantially parallel, and substantially parallel to a plane midway between them that runs through the central axis 302. Thus, the two side walls 318 do not run in a radial direction in this embodiment. Alternately, the two side walls 318 could run in radial directions, in which case the two side walls 318 would not be parallel. The side walls 318 are generally flat, but may be any convenient shape, curved, angled, beveled, and the like.

There are two restraints 316 for each recess 310, one disposed in each opposing notch 314 of a recess 310. The restraints 316 of a recess 310 extend from opposite side walls 318, which means that one of the restraints 316 of a recess 310 extends from a side wall 318 on a first side of a plane bisecting the notch 314, and the other restraint 316 extends from a side wall 318 on a second side of the plane bisecting the notch 314. The restraints extend from their respective side walls 318 along the edge of the recess 310. Each restraint 316 extends substantially parallel to the floor 320 of the notch 314. The restraints 316 are curved in this case, following the circular perimeter of the recess 310 in opposite directions. The restraints 316 are designed to engage with a groove in the rim of a charge liner. The restraints 316 flex outward as the charge liner is pressed into the recess 310, and snap into the groove of the charge liner to securely hold the charge in place. It should be noted that the restraints 316 of a recess 310 are located at the same elevation above the floor 320 of their respective notches 314, but may be at different elevations, for example if two grooves are provided in the charge liner to engage the two restraints 316.

The frame 300 has a nub 322 that extends from the first end 304 of the frame 300. The nub 322 is cylindrical here, but may be any convenient shape. For example, the nub 322 can have the shape of any regular polygon, for example square, triangular, pentagonal, and the like. A circular opening 325 at the end of the nub 322 leads to a passage through the frame 300 along the central axis 302. The passage may be the same as the passage 174 described above in connection with the perforation tool 200. The passage is not visible in FIG. 3A, but extends through the frame 300 to the second side 306 thereof to provide a conduit for the electrical conductor 176 described above.

Figure 3B:
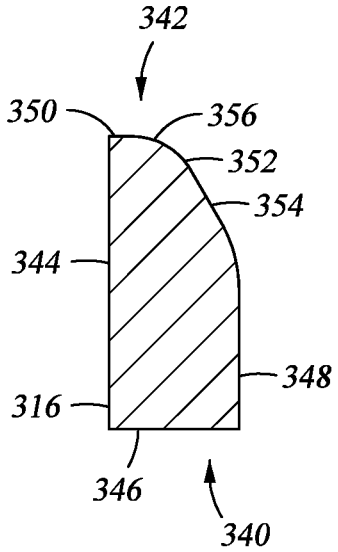
FIG. 3B is a cross-sectional view of a portion of the charge frame of FIG. 3A.

Adjacent to the center of the floor 320 of each notch 314 of the frame 300, extending from the first side 304 and substantially perpendicular thereto, is a first alignment feature 324. Since there are three notches 314 in the frame 300, there are three first alignment features 324. In general, one or a plurality of first alignment features 324 may be provided. The alignment features 324 can have any arrangement on the first end 304. For example, the alignment features 324 could be located between the notices 314 close to the edge of the first end 304, or near the nub 322. Alternately, two alignment features 324 could be used arranged on opposite sides of the nub 322. Any convenient arrangement of alignment features 324 could be used. The alignment features 324 here are posts that extend perpendicular to the first end 304 and are uniformly distributed around the nub 322. These posts have a plus shape in cross-section. Any type of alignment feature 324 could be used. For example, bumps, ridges, and other kinds of protrusions can be used, and can be mixed with recesses and/or notches, and/or posts with different cross-sectional profiles, for example square, hexagonal, or with an irregular shape. The alignment features 324 mate with alignment features on the second end 306 of the frame 300 to maintain alignment of two frames 300, one to the other. The alignment features 324 can also be used, if desired, to constrain rotation of one or more frames 300 within a perforation tool such as the perforation tool 100.

Where cylindrical connectivity features are used to connect a first frame with a second frame, as described herein, the first and second frame are operable in any rotational alignment. The axial features of the frames maintain electrical and fluid communication between the first frame and the second frame, so that the frames can be continuously rotated, one with respect to the other, and operability of the frames maintained. Where a discharge of a shaped charge creates a torque, the frames may relatively rotate following a discharge, potentially changing the direction of subsequent discharges. If discharge is intended in certain directions, rotation of a frame following a discharge can send subsequent discharges in unintended azimuthal directions. The alignment features described herein can be used to constrain unintended rotation of the frames, one with respect to another FIG. 3B is a cross-sectional view of a restraint 316 of FIG. 3A. The restraint 316 has a generally irregular shape in cross-section, with a first end 340 that has a rectangular shape and a second end 342 opposite from the first end 340 that has an irregular shape. The restraint 316 has a first surface 344 and a second surface 346 perpendicular to the first surface 344. The first surface 344 has a first width, and the second surface 346 has a second width less than the first width. The restraint 316 has a third surface 348 also perpendicular to the second surface 346, and therefore parallel to the first surface 344, with the second surface 346 connecting the first surface 344 and the third surface 348. The third surface 348 has a third width less than the first width. The restraint 316 has a fourth surface 350 perpendicular to the first surface 344, and therefore parallel to the second surface 346. The fourth surface has a fourth width that is less than the second width. The restraint 316 has a fifth surface 352 that connects the third surface 348 to the fourth surface 350. The fifth surface 352 has a straight portion 354 connected to the third surface 348 and a curved portion 356 connected to the fourth surface 350. The straight portion 354 forms an angle with the third surface 348 that depends on the length of the third surface 348, and may be between about 120° and about 170°, for example about 150°. The curved portion 356 may be circular, or otherwise rounded in a specific, or non-specific way. Here, the curved portion 356 has a radius of curvature that is about the same as the fourth length. The radius of curvature of the curved portion 356 depends on the dimensions of the other surfaces. The cross-sectional profile of the restraint 316 is selected to mate with a groove in the charge cup that holds the shaped charge, and to have a shape that successfully secures the restraint 316 in the groove.

Referring again to FIG. 3A, each restraint 316 extends from a base 317 attached to the side wall 318 of the notch 314. The base 317 has curved surfaces that connect the various surfaces of the restraint 316 to the side wall 318. Each curved surface of the base 317 connects from the side wall to one of the surfaces of the restraint 316 described above. The base 317 thus has a dimension that matches a corresponding dimension of the restraint 316 where the base 317 meets the restraint 316, and increases in areas of the base 317 approaching the side wall 314. The base 317 is thus thicker than the restraint 316 to provide a strong foundation for attaching the restraint to the side wall 314.

Each restraint 316 has a latch feature 329 at a distal end of the restraint 316. In this case, the latch feature 329 has the shape of a triangular prism with two parallel right triangular surfaces connected by rectangular surfaces. The right angle of the latch feature 329 abuts the first surface 344 of the restraint 316 described above in connection with FIG. 3B. The latch feature 329 has a thickness, distance of separation of the triangular surfaces, that is less than the first width of the first surface 344. In this case, the thickness of the latch feature 329 is about half the first width, but can be more or less than half the first width in other embodiments. The right angle of the latch feature 329 is positioned near and end 331 of the restraint 316, and the latch feature 329 rises from the right angle to an edge 333. A surface of the latch feature 329 slopes downward from the edge 333 along the restraint 316, such that the tallest part of the latch feature 329, having the edge 333, is near the end 331 of the restraint 316, and the latch feature 329 narrows in a direction along the restraint 316 away from the end 331.

Figure 3C:
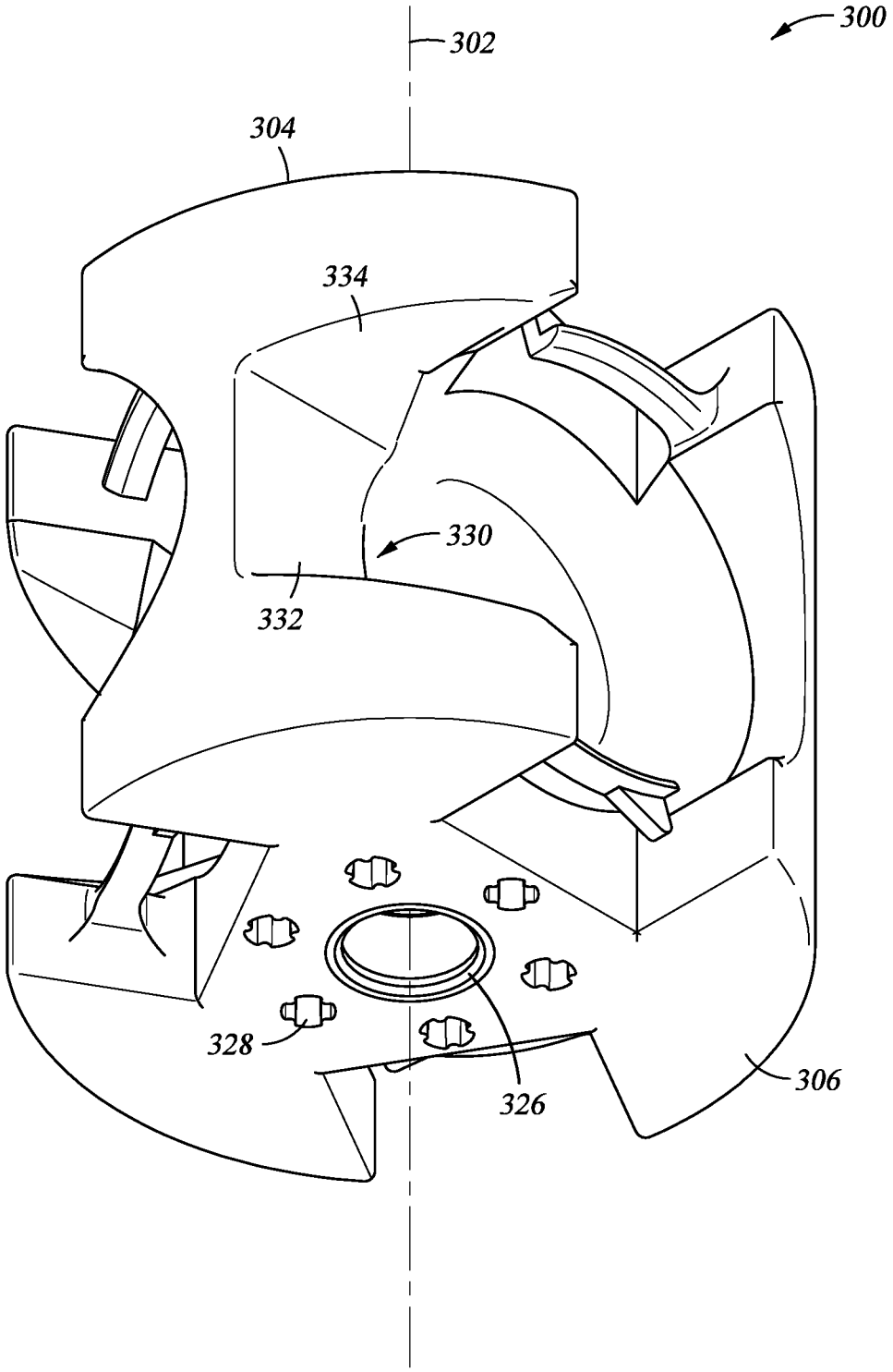
FIG. 3C is a different isometric view of the frame of FIG. 3A.

FIG. 3C is an isometric view of the frame 300 looking toward the second end 306. The second end 306 has an opening 326 that fluidly communicates with the nub 322 of FIG. 3A on the first end 304 by the passage extending through the frame 300. The opening 326 has a diameter larger than the diameter of the passage, as described in connection with the perforation tool 100. The diameter of the opening 326 is substantially the same as the outer diameter of the nub 322, so the nub 322 can fit into the opening 326 to stack multiple frames 300 together. The nub 322 can also fit with other components of a perforation tool, as described above. The opening 326 also accommodates coupling of other components of a perforation tool.

A plurality of second alignment features 328 are formed in the second end 306 of the frame 300. These alignment features 328 can engage with the first alignment features 324 of the first end 304. There are six second alignment features 328 on the second end 306, where there are only three alignment features 324 on the first end 304. As above, in general, one or a plurality of second alignment features may be provided. The six alignment features 328 here are recesses shaped to match the posts at the first end 304 of the frame 300 to allow two frames 300 to be engaged in two different relative orientations. The recesses 310 of two adjacent frames 300 coupled together can be aligned, pointing in the same direction, or the recesses 310 can be azimuthally displaced by 30°. The relative orientation of adjacent frames can be selected in this way by providing alignment features having any desired relationship to allow different relative orientations. It should be noted that the spacing of alignment features can be any useful spacing to allow positioning adjacent frames with a variety of different angular displacements.

Each recess 310 of each frame 300 also features a finger notch 330. The finger notch 330 is formed in the side 308 of the frame 300. The finger notch 330 is formed in the side 308 between the first and second ends 304 and 306 of the frame, on only one side of the recess 310. The finger notch 330 extends through the outer wall 312 of the recess 310, providing access to the recess 310 from the side. The finger notch 330 simplifies the process of extracting charges, for example spent charges, from the frame 300 by providing a lateral extraction method that minimizes stress on the restraints 316 as the charge is removed from the frame 300. The finger notch 330 can have any convenient shape. Here, the notch 330 has a flat floor 332 and substantially straight side walls 334. The side walls 334 are not parallel here, but there is no reason they could not be parallel.

Figure 3D:
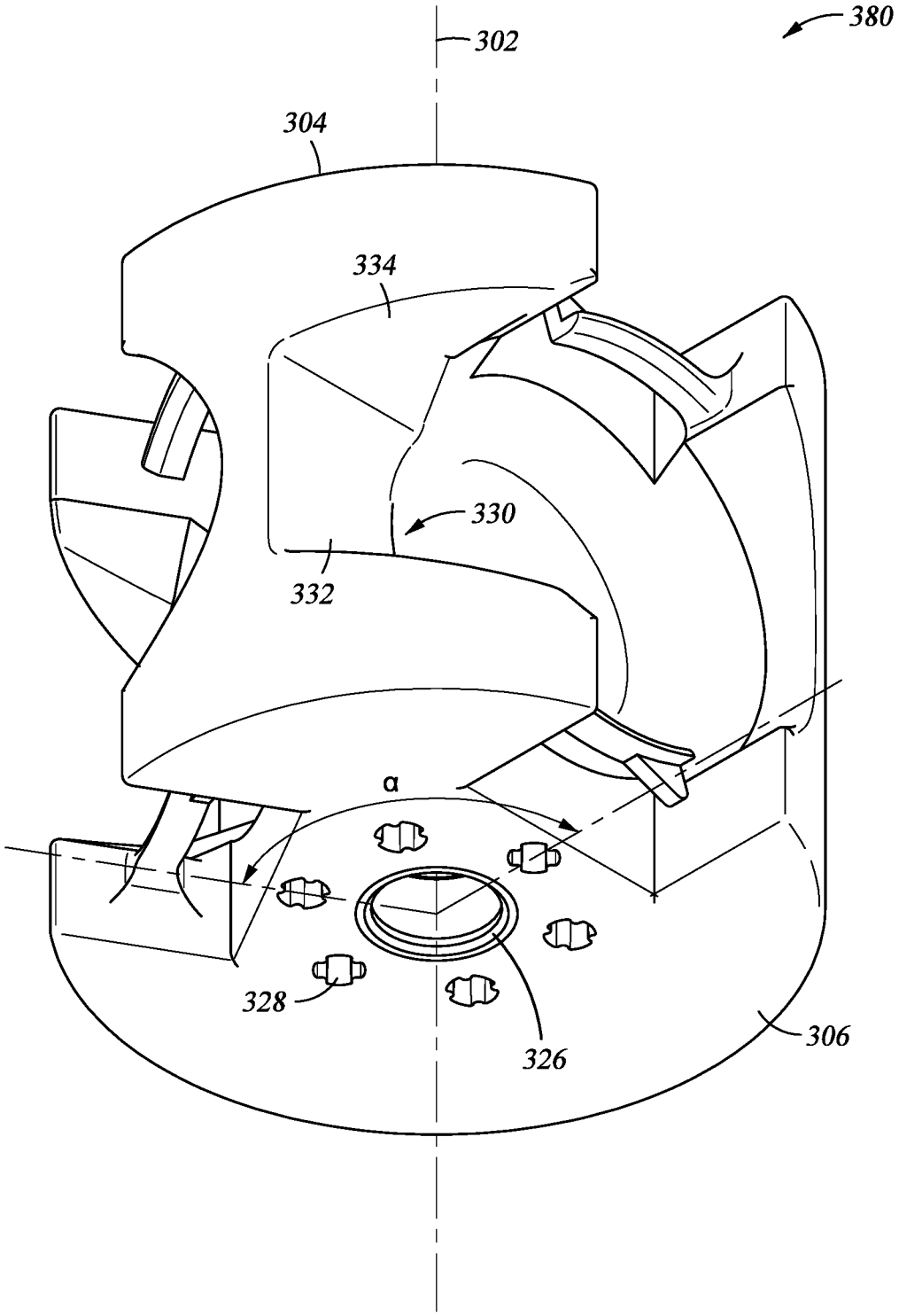
FIG. 3D is an isometric view of a frame according to another embodiment.

FIG. 3D is an isometric view of a frame 380 according to another embodiment. This isometric view is from the same perspective as the view of FIG. 3C. The frame in FIG. 3D is a variant that has only two of the recesses 310. The two recesses 310 of the frame 380 are also arranged in the same coplanar fashion as the recesses 310 of the frame 300 in FIG. 3C. Here, two recesses 310 are arranged at an angle α that is from 120° to 180°. Such frames 350 can be made with different angles α such that charge geometry for a single perforation tool can be distributed among a plurality of such angles and then selected using any suitable firing method. A single perforation tool can be fitted with an assortment of frames 300 and frames 350 to provide flexibility regarding the directions chosen for perforation While the foregoing is directed to embodiments of the present invention, other and further embodiments of the present disclosure may be devised without departing from the basic scope thereof, and the scope thereof is determined by the claims that follow.

What is claimed is:

1. An apparatus, comprising:

a housing;

a plurality of frames that fit inside the housing, each frame having a cylindrical shape with a central axis and a plurality of liners, each liner having an axis perpendicular to the central axis, wherein the axes of the liners of each frame are disposed in a plane perpendicular to the central axis, each liner has a retention member that extends around a circumference of the liner, and the frames are axially stackable;

an electrical conductor disposed along a central passage of each frame;

a plurality of shaped charges secured in the liners of the frames;

a bulkhead member disposed in the housing and forming a seal with the housing; and an initiator module disposed in the housing with the bulkhead member between the initiator module and the plurality of frames, wherein the initiator module can directly couple with one of the frames or with the bulkhead member, and the initiator module comprises a circuit plate disposed in a container in an orientation transverse to the central axis, the container comprising a first member and a second member separable from the first member, the first member having a plurality of clips that are configured to hold the circuit plate, the second member having an opening aligned with the central axis, and the initiator module further comprising a detonator that protrudes through the opening and is electrically connected to the circuit plate.

2. The apparatus of claim 1, wherein the bulkhead member electrically isolates the initiator module from the plurality of shaped charges.

3. The apparatus of claim 1, further comprising a detonation member disposed adjacent to the shaped charges, wherein the detonation member is disposed in the electrical conductor.

4. The apparatus of claim 1, wherein the electrical conductor contacts an interior wall of each central passage.

5. The apparatus of claim 4, wherein the electrical conductor is a tube.

6. The apparatus of claim 1, wherein the initiator module electrically couples to the electrical conductor by an electrical contact band.

7. A perforation tool, comprising:

a cylindrical housing having a plurality of perforation grooves formed therein;

a plurality of charge frames that fit inside the housing, each charge frame having a cylindrical shape with a central axis and a plurality of liners positioned adjacent to one of the perforation grooves, each liner having an axis perpendicular to the central axis, wherein the axes of the liners of each charge frame are disposed in a plane perpendicular to the central axis, each liner has a retention member that extends around a circumference of the liner, and the charge frames are axially stackable;

a plurality of shaped charges secured in the liners of the charge frames;

a bulkhead member disposed in the housing and forming a seal with the housing; and an initiator module disposed in the housing with the bulkhead member between the initiator module and the plurality of charge frames, wherein the initiator module is configured to directly couple with one of the charge frames or with the bulkhead member, and the initiator module comprises a circuit plate disposed in a container in an orientation transverse to the central axis, the container comprising a first member and a second member separable from the first member, the first member having a plurality of clips that are configured to hold the circuit plate, the second member having an opening aligned with the central axis, and the initiator module further comprising a detonator that protrudes through the opening and is electrically connected to the circuit plate.

8. The perforation tool of claim 7, wherein the bulkhead member electrically isolates the initiator module from the plurality of shaped charges.

9. The perforation tool of claim 8, further comprising an electrically conductive tube disposed in an axial passage formed through each charge frame.

10. The perforation tool of claim 9, further comprising a detonation member disposed adjacent to the shaped charges in the electrically conductive tube.

11. The perforation tool of claim 7, wherein each charge frame is made of a polymer material.

12. The perforation tool of claim 9, wherein the initiator module is configured to directly couple with the electrically conductive tube such that the detonator protrudes into the electrically conductive tube.

13. The perforation tool of claim 7, wherein the initiator module electrically couples with a charge frame using an electrical contact band.

14. A perforation tool, comprising:

a cylindrical housing;

a first perforation assembly disposed inside the housing, that first perforation assembly comprising a first frame for shaped charges, an initiator module, and a bulkhead member between the first frame and the initiator module; and a second perforation assembly disposed inside the housing, the second perforation assembly comprising a second frame for shaped charges electrically coupled to the initiator module of the first perforation assembly by an electrical conductor disposed through a central passage of the second frame; and a capsule charge disposed in the electrical conductor adjacent to one or more shaped charge locations of the second frame.

15. The perforation tool of claim 14, wherein each of the first frame and the second frame has a central passage, and the second frame is ballistically coupled to the initiator module by the central passage of the second frame.

16. The perforation tool of claim 14, wherein the electrical conductor is a tube, and an outer surface of the tube contacts an inner surface of the central passage.

17. The perforation tool of claim 14, wherein the bulkhead member has a central passage, an insulating member disposed in the central passage, and an electrical conductor disposed in the central passage within the insulating member.

18. The perforation tool of claim 14, wherein the capsule charge is a wireless capsule charge.

* * * * *